US006091052A

United States Patent [19]

Matsuo et al.

[11] Patent Number: 6,091,052

[45] Date of Patent: Jul. 18, 2000

[54] IMAGE FIXING ROLLER, IMAGE FIXING APPARATUS, AND IMAGE FIXING METHOD USING THE IMAGE FIXING ROLLER

[75] Inventors: Minoru Matsuo; Yuichi Jibiki, both of Kanagawa, Japan

[73] Assignee: Ricoh Company, Ltd., Tokyo, Japan

[21] Appl. No.: 09/372,579

[22] Filed: Aug. 12, 1999

Related U.S. Application Data

[63] Continuation of application No. 09/010,065, Jan. 21, 1998.

[30] Foreign Application Priority Data

| | | | |
|---|---|---|---|
| Jan. 21, 1997 | [JP] | Japan | 9-008607 |
| Dec. 22, 1997 | [JP] | Japan | 9-352874 |
| Dec. 22, 1997 | [JP] | Japan | 9-352875 |
| Dec. 22, 1997 | [JP] | Japan | 9-352876 |

[51] Int. Cl.[7] ..... H05B 1/00

[52] U.S. Cl. ..... 219/216; 392/346; 126/263.01; 126/400

[58] Field of Search ..... 219/209, 210, 219/216, 469, 470, 471, 505, 543, 544, 530, 540; 399/333; 492/46, 60, 228; 392/339, 340, 346; 126/263.01, 400

[56] References Cited

U.S. PATENT DOCUMENTS

| | | | |
|---|---|---|---|
| 3,689,736 | 9/1972 | Meyer | 219/505 |
| 4,013,871 | 3/1977 | Namiki et al. | 219/471 |
| 4,019,024 | 4/1977 | Namiki | 219/469 |
| 4,521,095 | 6/1985 | Mayer | 219/216 |
| 4,887,964 | 12/1989 | Takeuchi | 432/60 |
| 4,979,923 | 12/1990 | Tanaka | 392/339 |
| 5,254,380 | 10/1993 | Salyer | 126/400 |
| 5,403,995 | 4/1995 | Kishino et al. | 219/216 |
| 5,740,513 | 4/1998 | Matsuo et al. | 399/333 |
| 5,773,793 | 6/1998 | Matsuo | 219/216 |
| 5,786,564 | 7/1998 | Matsuo | 219/216 |
| 5,804,794 | 9/1999 | Matsuo et al. | 219/216 |
| 5,884,006 | 3/1999 | Frohlich et al. | 392/339 |
| 5,960,244 | 9/1999 | Matsuo et al. | 399/333 |

*Primary Examiner*—Teresa Walberg
*Assistant Examiner*—Fadi H. Dahbour
*Attorney, Agent, or Firm*—Oblon, Spivak, McClelland, Maier & Neustadt, P.C.

[57] ABSTRACT

An image fixing roller includes an exothermic phase transition layer which performs a plurality of phase transitions repeatedly from an amorphous state to a crystalline state. The exothermic phase transition layer may include a plurality of exothermic phase transition materials, or a plurality of exothermic phase transition component layers, each of which exothermic phase transition material or component layer has a different crystallization initiation temperature (Tci), a different exothermic peak temperature (Tcp) and a melting point temperature which is higher than that of a toner fixing temperature. An image fixing apparatus using the above-mentioned image fixing roller and a method of fixing toner images on an image receiving material, using the image fixing roller are proposed.

24 Claims, 13 Drawing Sheets

Tg : GLASS TRANSITION TEMPERATURE

Tci : CRYSTALLIZATION INITIATION TEMPERATURE

Tcp: CRYSTALLIZATION PEAK TEMPERATURE

Tm : MELTING POINT

Pg : ENDOTHERMIC PEAK

Pc : EXOTHERMIC PEAK FOR CRYSTALLIZATION

Pm : ENDOTHERMIC PEAK FOR FUSING

IMAGE FIXING ROLLER, IMAGE FIXING APPARATUS, AND IMAGE FIXING METHOD USING THE IMAGE FIXING ROLLER

This application is a continuation of application Ser. No. 09/010,065 filed on Jan. 21, 1998.

BACKGROUND OF THE INVENTION

1. Field of the Invention

The present invention relates to an image fixing roller for thermally fixing images on an image receiving material, an image fixing apparatus comprising the image fixing roller, and a method of fixing toner images on an image receiving material, using the image fixing roller, which are used in image formation apparatus, such as a copying machine, printer and facsimile apparatus.

2. Discussion of Background

In conventional image formation apparatus such as a copying machine, printer and facsimile apparatus, developed toner images are fixed on an image receiving material by use of an image fixing apparatus comprising an image fixing roller and a pressure application roller.

In the image fixing apparatus, the image receiving material to which developed toner images are transferred is caused to pass between the image fixing roller and the pressure application roller, and the toner of the developed toner images is fused or softened and then thermally fixed to the image receiving material.

This kind of image fixing roller is warmed up before use until the outer peripheral surface of the image fixing roller reaches a predetermined temperature which is necessary for image fixing, that is, an image-fixing possible temperature, for instance, to 180° C. Since this warm-up takes a relatively long period of time, a preheating system for starting the preheating of the image fixing roller when a main switch of the image formation apparatus is turned on is in general use.

However, the power consumption of the preheating system for the image fixing roller is so large that this kind of preheating is not always preferable for use in view of global environment conservation and energy saving.

The applicants of the present application previously proposed an image fixing roller comprising a cylindrical core metal, an exothermic phase transition layer provided on the cylindrical core metal, comprising an exothermic phase transition material capable of performing reversible phase transition from an amorphous state to a crystalline state and vice versa, and a protective layer provided on the exothermic phase transition layer, as disclosed, for example, in Japanese Laid-Open Patent Application 7-140823. When this image fixing roller is used, before the outer peripheral surface of the image fixing roller is caused to reach the image-fixing possible temperature by a heater, the temperature elevation rate of the outer peripheral surface of the image fixing roller is significantly increased by the thermal energy which is released when the phase transition of the exothermic phase transition material from an amorphous state to a crystalline state is carried out, in comparison with the temperature elevation rate of the outer peripheral surface of the image fixing roller which is attained only by use of the heater, whereby the shortening of the warm-up time for the image fixing roller and the power consumption therefor are attained.

In this image fixing roller, since the thermal energy which is liberated when the exothermic phase transition material is crystallized is utilized, it is necessary that the exothermic phase transition material be rapidly cooled to change its state from a fused state to an amorphous state and have the properties that the exothermic phase transition material in the amorphous state can be changed to a crystallized state when the temperature of the exothermic phase transition material is elevated.

Examples of inorganic exothermic phase transition materials that can be used as the above-mentioned exothermic phase transition material are multi-element materials composed of any of elements of Group III through Group IV of the Periodic Table which are known as having a region of becoming amorphous. Of such inorganic exothermic phase transition materials, chalcogen and chalcogenide compounds can be rapidly crystallized to liberate a large quantity of crystallization heat and therefore are particularly preferable exothermic phase transition materials for use in the above-mentioned image fixing roller.

Furthermore, as organic exothermic phase transition materials that can be used as the above-mentioned exothermic phase transition material, crystalline thermoplastic resins, for example, polyesters such as PET (polyethylene terephthalate) and PBT (polypropylene terephthalate) resins, are known as having a region of becoming amorphous. Furthermore, it is known that low-molecular weight organic materials such as diphenyl isopthalate derivatives and bisphenol derivatives exothermically liberate heat when crystallized.

For example, FIG. 1 is a graph showing the differential thermal analysis characteristics of a representative exothermic phase transition material (Se) measured by a differential thermal analyzer (DTA). In FIG. 1, L1 indicates a control temperature straight line. FIG. 1 shows an exothermic-endothermic curve Q of the exothermic phase transition material (Se) at the time of a 10-degree temperature elevation per 10 minutes. Tg indicates the glass transition temperature of the exothermic phase transition material (Se); Pg and Pm, the endothermic peaks thereof; Pc, an exothermic peak of thereof; Tcp, the exothermic peak temperature thereof; Tci, the crystallization initiation temperature thereof at which the phase transition from an amorphous state to a crystalline state is initiated; Tcf, the crystallization finalization temperature thereof at which the phase transition of the material (Se) is finalized and the material (Se) reaches the control temperature; and Tm, the fused temperature thereof or the melting point thereof. These temperature characteristics of the material (Se) slightly shift to a higher temperature side as the control rate is increased.

With reference to this exothermic-endothermic curve Q, the small endothermic peak Pg is first observed at the glass transition temperature Tg in the course of the passage of time or the elevation of the temperature, and the large exothermic peak Pc is then observed, which is caused to appear by the crystallization of the material (Se). Subsequently, the endothermic peak Pm is then observed, which is caused to appear by the melting of the material (Se).

In order to further shorten the warm-up time of the image fixing roller, it is necessary that the temperature of the outer peripheral surface of the image fixing roller be quickly elevated to a temperature above the image fixing possible temperature or the toner softening or fusing temperature.

If the exothermic phase transition material is caused to exothermically liberate heat at a temperature level which is far below the image fixing possible temperature, the exothermically liberated heat is caused to dissipate away before the temperature of the outer peripheral surface of the image fixing roller reaches the image fixing possible temperature, so that the exothermic phase transition material cannot be used effectively for shortening the warm-up time of the image fixing roller.

On the other hand, if the exothermic phase transition material is caused to exothermically liberate heat after the outer peripheral surface of the image fixing roller reaches the image fixing possible temperature, the warm-up time of the image fixing roller cannot be shortened.

If the exothermic temperature range in which the exothermic material liberates heat and terminates the liberation of the heat is excessively higher than the image fixing possible temperature, the liberated heat increases the temperature of the surface of the image fixing roller even after the surface of the image fixing roller reaches the image fixing possible temperature, so that the so-called overheating of the image fixing roller takes place.

However, each exothermic phase transition material has its own particular crystallization temperature characteristics such as crystallization initiation temperature Tci, exothermic peak temperature Tcp, melting point Tm, and crystallization finalization temperature Tcf, so that it is desired to obtain an exothermic phase transition material having suitable crystallization temperature characteristics for the image fixing roller, for instance, an exothermic phase transition material with the temperature range from the crystallization initiation temperature Tc through the melting point Tm thereof being in the range of 80 to 200° C. for use with a commercially available image fixing roller. However it is extremely difficult to obtain an exothermic phase transition material with the above-mentioned temperature range.

SUMMARY OF THE INVENTION

It is therefore a first object of the present invention to provide an image fixing roller which is capable of significantly shortening the warm-up time of the image fixing roller, with the freedom of the choice of the exothermic phase transition material for the image fixing roller being increased, with significant elimination of restrictions on the production of the image fixing roller, and with the reduction of the power consumption for a heater for the image fixing roller.

A second object of the present invention is to provide an image fixing apparatus comprising the above-mentioned image fixing roller.

A third object of the present invention is to provide a method of fixing toner images on an image receiving material, using the above-mentioned image fixing roller.

The first object of the present invention can be achieved by an image fixing roller comprising:

1) a core,
2) a heating element; and
3) an exothermic phase transition layer which performs a plurality of phase transitions repeatedly from an amorphous state to a crystalline state, comprising a plurality of exothermic phase transition materials, each of which has a different crystallization initiation temperature (Tci), a different exothermic peak temperature (Tcp) and a melting point temperature which is higher than that of a toner fixing temperature, formed on the core.

In the above image fixing roller, the exothermic phase transition layer may comprise a plurality of component layers which are overlaid, each component layer comprising at least one of the exothermic phase transition materials and having a different crystallization initiation temperature (Tci), a different exothermic peak temperature (Tcp) and a melting point temperature which is higher than that of a toner fixing temperature.

Further, in the above image fixing roller, the component layers may be overlaid in such an order that the crystallization initiation temperature (Tci) of each component layer increases in the direction toward the outer surface of the image fixing roller.

In the above image fixing roller, the exothermic phase transition layer may further comprise a barrier layer between each of the component layers, the barrier layer having a melting point which is higher than any of the melting points of the component layers adjacent to the barrier layer.

In the image fixing roller of the present invention, when the exothermic phase transition materials are placed in an increasing order of the crystallization initiation temperatures (Tci) thereof from low to high, the respective crystallization initiation temperatures TciA and TciB and the respective exothermic peak temperatures TcpA and TcpB of two adjacent exothermic phase materials A and B in terms of the crystallization initiation temperature thereof may be in such a relationship that TciB is higher than TciA, but lower than TcpA, and TcpB is higher than TcpA.

In the image fixing roller of the present invention, the exothermic phase transition materials are preferably mutually insoluble when fused.

The second object of the present invention can be achieved by an image fixing apparatus comprising:

a) an image fixing roller comprising:
   1) a core,
   2) a heating element; and
   3) an exothermic phase transition layer, wherein the exothermic phase transition layer performs a plurality of phase transitions repeatedly from an amorphous state to a crystalline state, comprising a plurality of exothermic phase transition materials, each of which has a different crystallization initiation temperature (Tci), a different exothermic peak temperature (Tcp) and a melting point temperature which is higher than that of a toner fixing temperature, formed on the core; and the heating element heats the exothermic phase transition layer to perform the plurality of phase transition successively, fusing at least one of the exothermic phase transition materials, and
b) a cooling member which cools the exothermic phase transition layer to perform the plurality of phase transition repeatedly, cooling the fused exothermic phase transition material.

In the above image fixing apparatus, the cooling member may cool the phase transition layer with such a cooling rate that an exothermic phase transition material having the highest melting point of all of the exothermic phase transition materials can be subjected to phase transition from a fused state to an amorphous state.

Further, in the above image fixing apparatus, the cooling member may cool the phase transition layer with such a cooling rate that an exothermic phase transition material which requires the highest cooling rate of all of the exothermic phase transition materials can be subjected to phase transition from a fused state to an amorphous state.

The second object of the present invention can also be achieved by an image fixing apparatus comprising:

(a) an image fixing roller comprising:
   1) a hollow core,
   2) a heating element which is built in the hollow core,
   3) an exothermic phase transition layer having a melting point temperature which is higher than that of a toner fixing temperature, provided on the outer surface of the hollow core, which exothermic phase transition layer performs a plurality of phase transitions repeatedly from an amorphous state to a crystalline state, and comprises a first exothermic phase transition material having a crystallization initiation temperature (Tci1), an exothermic peak temperature (Tcp1), and a melting point (Tm1), and a second exothermic phase transition material having a crystallization initiation temperature (Tci2) which is lower than the crystallization initiation temperature (Tci1) of the first exothermic phase transition layer, an exothermic peak temperature (Tcp2), and a melting point (Tm2), the first exothermic phase transition material and the second exothermic phase transition material being subjected to phase change from an amorphous state to a crystalline state to a fused state by the heating element, to utilize the heat liberated from the exothermic phase transition layer for image fixing in the course of the phase change from the amorphous state to the crystalline state, 4) a protective layer provided on the outer surface of the exothermic phase transition layer, and (b) a cooling member which cools the first exothermic phase transition material and/or the second exothermic phase transition material in the fused state to a crystalline solid state from outside the exothermic phase transition layer or from inside the hollow core.

The second object of the present invention can also be achieved by an image fixing apparatus comprising:

(a) an image fixing roller comprising:

1) a hollow core, 2) a heating element which is built in the hollow core, 3) an exothermic phase transition layer having a melting point temperature which is higher than that of a toner fixing temperature, provided on the outer surface of the hollow core, which exothermic phase transition layer performs a plurality of phase transitions repeatedly from an amorphous state to a crystalline state, and comprises a first exothermic phase transition layer comprising a first exothermic phase transition material having a crystallization initiation temperature (Tci1), an exothermic peak temperature (Tcp1), and a melting point (Tm1), and a second exothermic phase transition layer comprising a second exothermic phase transition material having a crystallization initiation temperature (Tci2) which is lower than the crystallization initiation temperature (Tci1) of the first exothermic phase transition layer, an exothermic peak temperature (Tcp2) and a melting point (Tm2), the first exothermic phase transition material and the second exothermic phase transition material being subjected to phase change from an amorphous state to a crystalline state to a fused state by the heating element, to utilize the heat liberated from the exothermic phase transition layer for image fixing in the course of the phase change from the amorphous state to the crystalline state, 4) a protective layer provided on the outer surface of the exothermic phase transition layer, and (b) a cooling member which cools the first exothermic phase transition material and/or the second exothermic phase transition material in the fused state to a crystalline solid state from outside the exothermic phase transition layer or from inside the hollow core.

In the above image fixing apparatus, the first exothermic peak temperature (Tcp1) of the first exothermic phase transition material may be lower than the melting point (Tm2) of the second exothermic phase transition material.

Furthermore, in the above image fixing apparatus, the exothermic phase transition layer may further comprise a thermal conductive material having a melting point which is higher than any of the melting points of the first exothermic phase transition material and the second exothermic phase transition material, the first exothermic phase transition material and the second exothermic phase transition material are made of substantially the same material, and are in the form of particles, and the first exothermic phase transition material has an average particle size lager than that of the second exothermic phase transition material, and the surface of the particles of at least one of the first exothermic phase transition material or the second exothermic phase transition material is coated with the thermal conductive material, or the first exothermic phase transition material and the second exothermic phase transition material may be discontinuously dispersed in the thermal conductive material.

Alternatively, in the above image fixing apparatus, the exothermic phase transition layer may further comprise a thermal conductive material having a melting point which is higher than any of the melting points of the first exothermic phase transition material and the second exothermic phase transition material, the first exothermic phase transition material and the second exothermic phase transition material are in the form of particles and are discontinuously dispersed in the thermal conductive material.

In the above image fixing apparatus, the exothermic phase transition layer may further comprise a barrier layer having a melting point which is higher than any of the melting points of the first exothermic phase transition layer and the second exothermic phase transition layer between the first exothermic phase transition layer and the second exothermic phase transition layer, the barrier layer comprising a thermal conductive material having a melting point which is higher than any of the melting points of the first exothermic phase transition layer and the second exothermic phase transition layer.

Further, in the image fixing apparatus of the present invention, the first exothermic phase transition layer may be overlaid on the second exothermic phase transition layer in such a manner that the first exothermic phase transition layer is provided so as to be located at an outer position away from the core.

The first exothermic phase transition layer may further comprise a thermal conductive material having a melting point which is higher than any of the melting points of the first exothermic phase transition material and the second exothermic phase transition material, in which thermal conductive material, the first exothermic phase transition material is dispersed, and the second exothermic phase transition layer further comprises a thermal conductive material having a melting point which is higher than any of the melting points of the first exothermic phase transition material and the second exothermic phase transition material, in which thermal conductive material, the second exothermic phase transition material is dispersed.

The second object of the present invention can also be achieved by an image fixing roller apparatus comprising:

image fixing roller means for fixing toner images on an image transfer sheet, comprising an exothermic phase transition layer which performs a plurality of phase transitions repeatedly from an amorphous state to a crystalline state, comprising a plurality of exothermic phase transition materials, each of which has a different crystallization initiation temperature (Tci), a different exothermic peak temperature (Tcp) and a melting point temperature which is higher than that of a toner fixing temperature, heating means for heating the exothermic phase transition layer to perform the plurality of phase transition successively, fusing at least one of the exothermic phase transition materials, and cooling means for cooling the exothermic phase transition layer to perform the plurality of phase transition repeatedly, cooling the fused exothermic phase transition material.

The third object of the present invention can be achieved by a method of fixing toner images on an image transfer sheet, using an image fixing roller comprising an exothermic phase transition layer having a melting point temperature which is higher than that of a toner fixing temperature, which exothermic phase transition layer performs a plurality of phase transitions repeatedly from an amorphous state to a crystalline state, and comprises a first exothermic phase transition material having a crystallization initiation temperature (Tci1) and a second exothermic phase transition material having a crystallization initiation temperature (Tci2) which is lower than the crystallization initiation temperature (Tci1) of the first exothermic phase transition layer, comprising the steps of:

subjecting the second exothermic phase transition material to the phase change from an amorphous state to a crystalline state by heating the second exothermic phase transition material, thereby liberating heat from the second exothermic phase transition material, and subjecting at least the first exothermic phase transition material to the phase change from an amorphous state to a crystalline state by heating the second exothermic phase transition material, thereby liberating heat from the first exothermic phase transition material, to successively use the liberated heat from the second exothermic phase transition material and the liberated heat from the first exothermic phase transition material successively in the course of the respective phase change from the amorphous state to the crystalline state.

The above method may further comprise a step of returning the crystalline state of each of the first and second phase transition materials to an amorphous state.

In the above method, the step of returning the crystalline state of each of the first and second phase transition materials to an amorphous state may comprise:

a process of fusing each of the first and second phase transition materials in the crystalline state to a fused state, and a process of cooling each of the first and second phase transition materials in the fused state to an amorphous state.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 2:
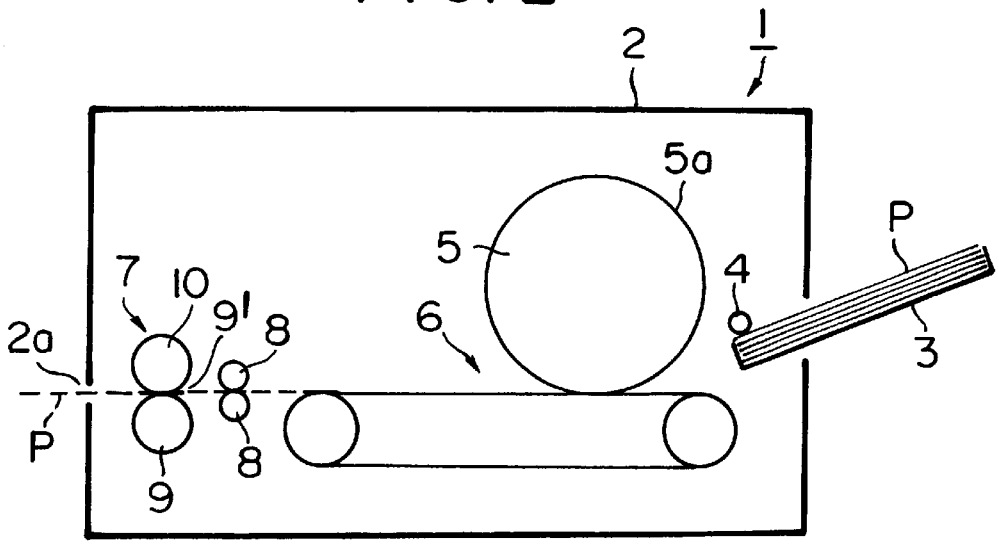
FIG. 2 is a schematic diagram of a copying machine in which an image fixing roller of the present invention can be employed.

With reference to FIG. 2, an example of the image fixing roller of the present invention which is employed in an electrophotographic copying machine will now be explained.

In FIG. 2, reference numeral 1 indicates the electrophotographic copying machine, which comprises a recording sheet feed cassette 3 which is detachably incorporated into the electrophotographic copying machine 1, a recording sheet feed roller 4 for feeding image transfer sheets P set in the recording sheet feed cassette 3 into a main body 2 of the electrophotographic copying machine 1, a drum-shaped photoconductor 5 comprising a photosensitive layer 5*a* on the surface thereof, an image transfer unit 6 for transferring toner images formed on the photosensitive layer 5*a* of the drum-shaped photoconductor 5 to one of the surfaces of the image transfer sheet P, and a pair of auxiliary rollers 8, 8 for guiding the image transfer sheet P into an image fixing section 7 after the transfer of the toner images to the image transfer sheet P.

The image fixing unit 7 comprises a pressure application roller 9 comprising a core metal made of a metal such as aluminum or iron, and an elastic material such as rubber provided on the outer peripheral surface of the core metal, and an image fixing roller 10 which is driven in rotation, following the rotation of the pressure application roller 9. The toner images transferred to the image transfer sheet P are thermally fixed to the image transfer sheet P by the heat from the image fixing roller 10 as the image transfer sheet P is guided by the auxiliary rollers 8, 8. The image transfer sheet P is then discharged from the main body 2 of the electrophotographic copying machine 1 through a discharge outlet 2*a*.

Figure 3:
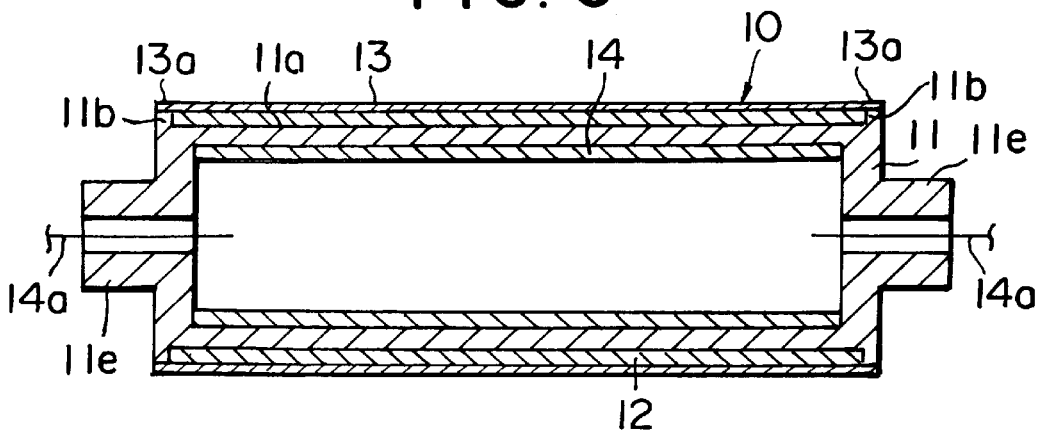
FIG. 3 is an enlarged schematic cross-sectional view of an example of an image fixing roller of the present invention.

As shown in FIG. 3, the image fixing roller 10 comprises a hollow core metal 11 made of a metal such as an aluminum alloy with high thermal conductivity on the outer peripheral surface of the core metal 11, a circumferential concave portion 11*a* is formed, in which an exothermic phase transition layer 12 is provided. The exothermic phase transition layer 12 is covered with a protective layer 13, and the opposite end portions 13*a* of the protective layer 13 are in tight contact with end portions 11*b* of the core metal 11. On the inner surface of the hollow core metal 11 is provided a heater 14. Electric power is supplied to the heater 14 through wires 14*a*, 14*a*. The heater 14 may be a cylindrical heater as shown in FIG. 3, or a halogen lamp or the like (not shown).

Figure 4:
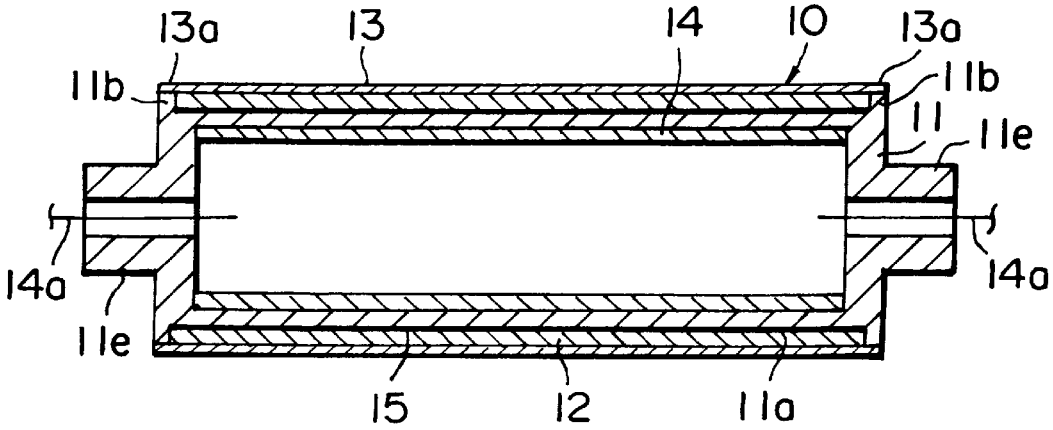
FIG. 4 is an enlarged schematic cross-sectional view of another example of an image fixing roller of the present invention.

The image fixing roller 10 in this example is essentially composed of the core metal 11, the exothermic phase transition layer 13 and the protective layer 12 as explained above. As shown in FIG. 4, an adhesive layer 15, an electrically heat emitting layer or an insulating layer may also be added when necessary.

The exothermic phase transition layer 12 comprises at least two exothermic phase transition materials, each exothermic phase transition material being capable of performing reversible phase transition from an amorphous state to a crystalline state and vice versa, so that the exothermic phase transition layer 12 has at least two crystallization initiation temperatures at which each exothermic phase transition material performs the phase transition from an amorphous state to a crystalline state.

More specifically, for example, the exothermic phase transition layer 12 may be composed of a mixture of a second exothermic phase transition material which initiates the above-mentioned phase transition in a low temperature region when heated by the heater 14, exothermically liberating heat from the second exothermic phase transition material, and a first exothermic phase transition material which initiates the above-mentioned phase transition in a high temperature region, as induced by the heat liberated exothermically from the second exothermic phase transition material, and exothermically liberates heat therefrom.

Specific examples of the above-mentioned first exothermic phase transition material and second exothermic phase transition material for use in the exothermic phase transition layer 12 are the materials with the following known crystallization initiation temperature Tci, exothermic peak temperature Tcp, melting point Tm, crystallization finalization temperature Tcf, and exothermic latent heat for crystallization Lc, as shown in TABLE 1, which may be-selectively used in combination:

TABLE 1

| Exothermic phase transition Material | Tci (° C.) | Tcp (° C.) | Tcf (° C.) | Tm (° C.) | Le (cal/g) |
|---|---|---|---|---|---|
| Diphenyl isopthalate derivative | 55 | 70 | 95 | 210 | 25 |
| Diphenyl carbonate-adduct Bisphenol A derivative | 80 | 100 | 130 | 215 | 35 |
| Bisphenol A | 45 | 61 | 80 | 150 | 36 |
| Polyethylene terephthalate | 90 | 120 | 140 | 230 | 30 |
| Selenium | 100 | 140 | 170 | 217 | 17 |
| SeTe alloy containing 8 wt. % of Te | 100 | 150 | 180 | 230 | 16 |
| SeTe alloy containing 50 wt. % of Te | 90 | 110 | 130 | 280 | 20 |

It is preferable that the exothermic phase transition materials used in the exothermic phase transition layer 12 be not mutually soluble when fused.

This is because when the exothermic phase transition layer 12 is initialized to utilize the heat exothermically generated by the phase transition thereof, by turning ON of a power source switch after the switch is turned OFF, the exothermic phase transition materials are once heated to a temperature above any of the melting points of the exothermic phase transition materials and fused, and then cooled. Therefore in order to use the exothermic phase transition materials repeatedly, it is necessary that the exothermic phase transition materials not mutually react, for instance, by chemical reaction, and be not soluble when fused. In particular, when the two exothermic phase transition materials mutually dissolve when fused, the materials are denatured and it becomes difficult to make them amorphous. Furthermore, it is considered that the crystallization initiation temperature, the exothermic peak temperature and the melting point thereof may be changed, and there is the risk that it becomes difficult to conduct the recrystallization.

The second exothermic phase transition material which is capable of initiating the exothermic heat liberation in a low temperature region, and the first exothermic phase transition material which is capable of initiating the exothermic heat liberation in a high temperature region are appropriately mixed, and the second exothermic phase transition material is heated in a low temperature heating state, using the heater 14, so as to liberate the exothermic heat from the second exothermic phase transition material, and to rapidly elevate the temperature of the surface of the image fixing roller 10 to the crystallization initiation temperature of the second exothermic phase transition material. By the heat which is rapidly liberated exothermically from the second exothermic phase transition material, the crystallization of the first exothermic phase transition material is induced, whereby the temperature of the surface of the image fixing roller 10 can be rapidly raised. When an exothermic phase transition material having a single crystallization initiation temperature is employed, the exothermic phenomenon takes place in a narrow temperature range. However, when a mixture of two or more exothermic phase transition materials, having two or more crystallization initiation temperatures, is employed, heat can be exothermically liberated rapidly in a wide temperature range.

The above mechanism will now be explained in detail with reference to FIG. 5.

Figure 5:
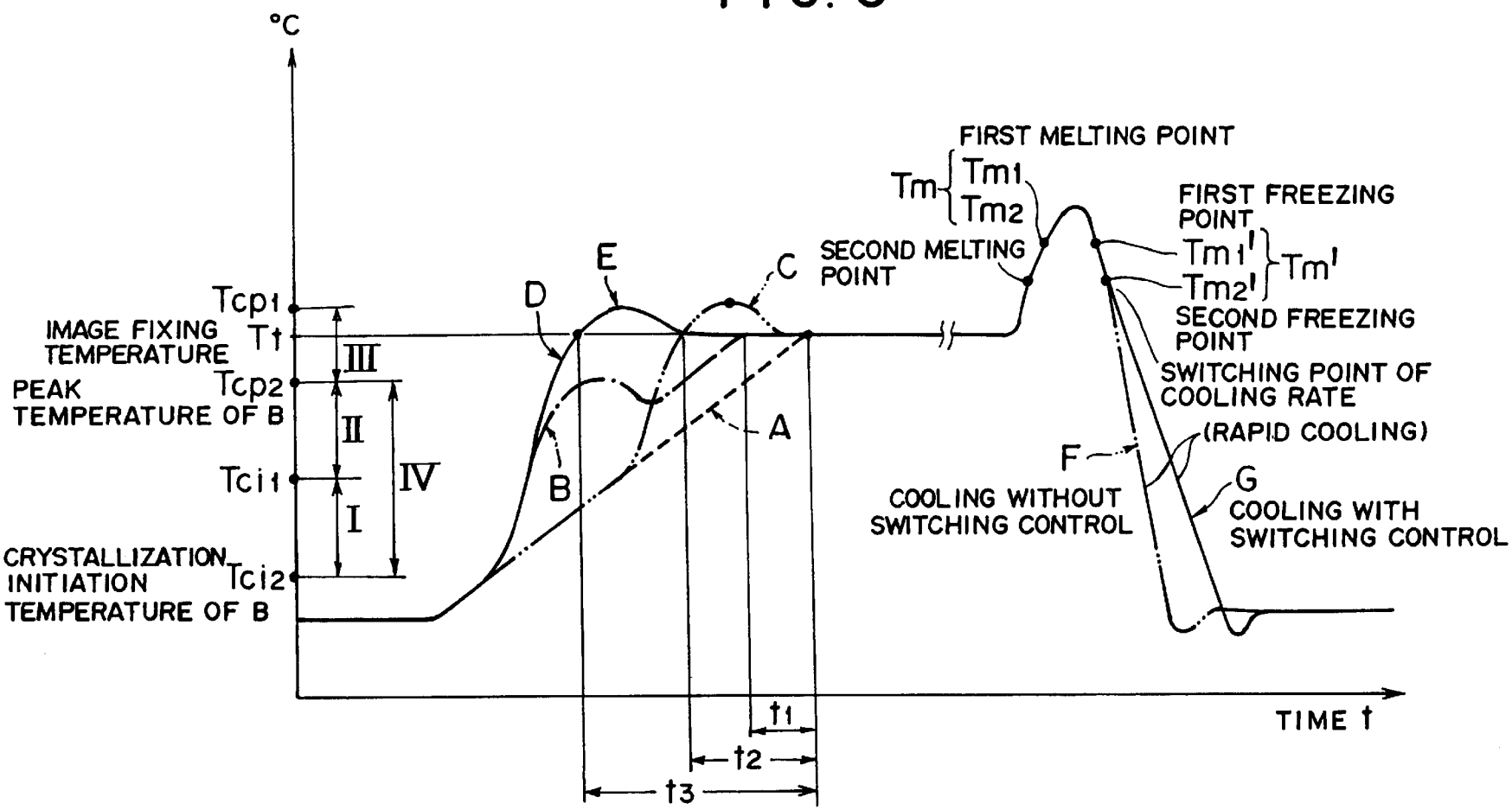
FIG. 5 is a diagram in explanation of the temperature elevation characteristics of an image fixing roller of the present invention.
Figure 6:
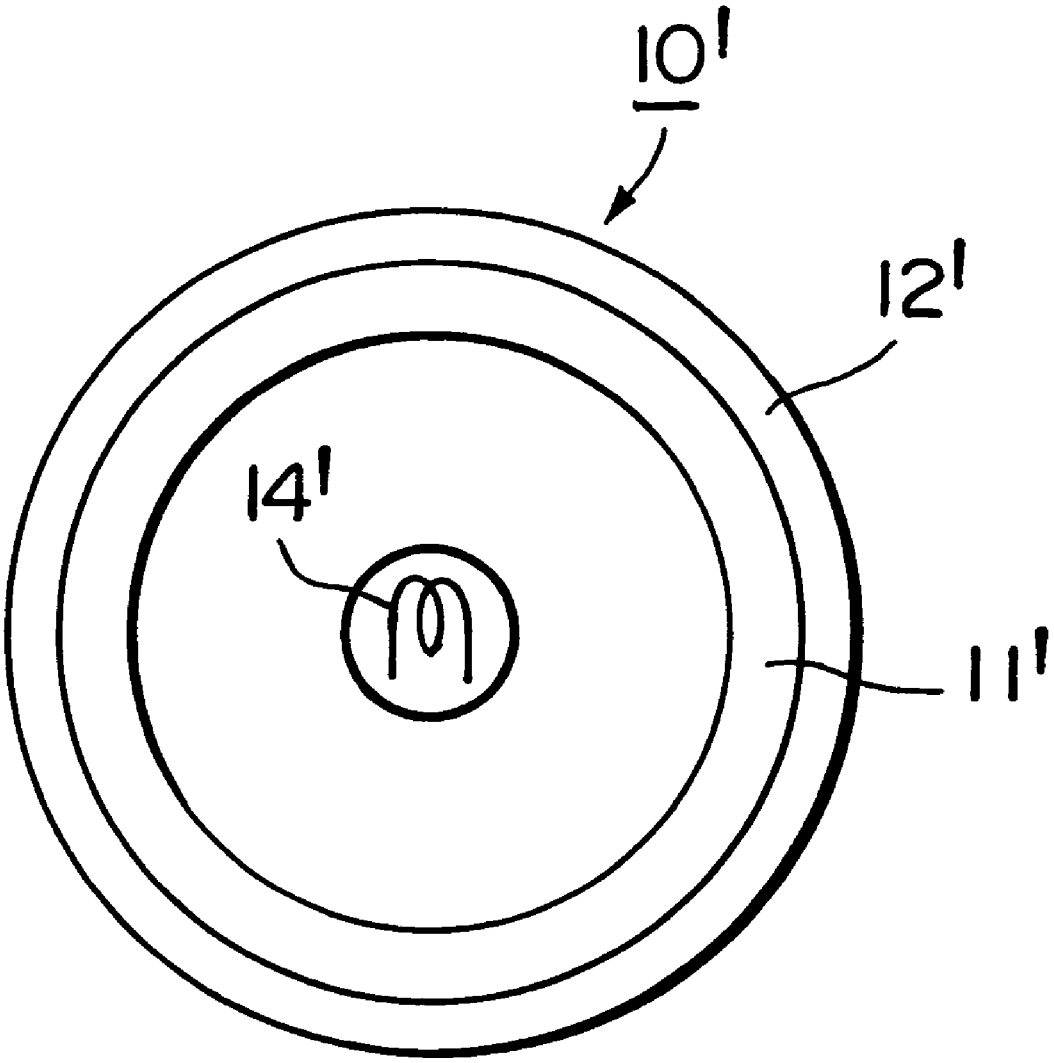
FIG. 6 is a schematic cross-sectional view of a conventional image fixing roller.

FIG. 5 is a diagram for comparative explanation of the temperature—time relationship of the temperature elevation characteristics of the following image fixing rollers: the temperature—time relationship of the temperature elevation characteristics of a conventional image fixing roller 10', indicated by broken line A; the temperature—time relationship of the temperature elevation characteristics of an image fixing roller provided with an exothermic phase transition layer 12 consisting of the second exothermic phase transition material, indicated by a curve of alternate long and short dash line B; the temperature—time relationship of the temperature elevation characteristics of an image fixing roller provided with an exothermic phase transition layer 12 consisting of the first exothermic phase transition material, indicated by a curve of alternate long and two short dashes line C; and the temperature—time relationship of the temperature elevation characteristics of an image fixing roller 10 provided with an exothermic phase transition layer 12 composed of a mixture of the first and second exothermic phase transition materials, indicated by a curve of solid line D. The structure of the conventional image fixing roller 10' is shown, for example, in FIG. 6, in which the image fixing roller 10' is composed of a hollow core metal 11', a release layer 12' provided on the outer peripheral surface of the hollow core metal 11', and a halogen lamp 14' which is built inside the hollow core metal 11' for heating the image fixing roller 10'.

The rise-up time for the image fixing roller provided with the exothermic phase transition layer 12 consisting of the second exothermic phase transition material can be shortened by t1 in comparison with the rise-up time for the conventional image fixing roller 10'; the rise-up time for the image fixing roller provided with the exothermic phase transition layer 12 consisting of the first exothermic phase transition material can be shortened by t2 in comparison with the rise-up time for the conventional image fixing roller 10'; and the rise-up time for the image fixing roller 10 provided with the exothermic phase transition layer 12 composed of a mixture of the first and second exothermic phase transition materials can be shortened by t3 in comparison with the rise-up time for the conventional image fixing roller 10'.

It is preferable that the exothermic peak temperature Tcp1 of the first exothermic phase transition material be lower than the melting point Tm2 of the second exothermic phase transition material, since it is preferable that the second exothermic phase transition material remain in a solid state at the exothermic peak temperature Tcp1 of the first exothermic phase transition material. This is because if the second exothermic phase transition material is fused at the exothermic peak temperature Tcp1 of the first exothermic phase transition material, there is the risk that it becomes difficult to maintain the rigidity of the surface of the image fixing roller 10 and to maintain the nip 9' between the pressure application roller 9 and the image fixing roller 10 (refer to FIG. 2), so that it will become difficult to perform proper image fixing.

A smooth and gradual temperature elevation characteristic curve D can be obtained by a combination of (a) a second exothermic phase transition material having a crystallization initiation temperature Tci2 and an exothermic peak temperature Tcp2 and (b) a first exothermic phase transition material having a crystallization initiation temperature Tci1 which is between the crystallization initiation temperature Tci2 and the exothermic peak temperature Tcp2 of the second exothermic phase transition material and an exothermic peak temperature Tcp1 which is higher than the exothermic peak temperature Tcp2 of the second exothermic phase transition material.

When the temperature of the second exothermic phase transition material is elevated to a temperature above the exothermic peak temperature Tcp2 thereof, the temperature of the second exothermic phase transition material is then decreased, so that the elevation of the temperature of the image fixing roller 10 is slowed down. However, in the case where there is the first exothermic phase transition material having a crystallization initiation temperature Tci1 which is between the crystallization initiation temperature Tci2 and the exothermic peak temperature Tcp2 of the second exothermic phase transition material, when the temperature of the image fixing roller 10 exceeds the crystallization initiation temperature Tci1 by the heat exothermically liberated from the second exothermic phase transition material, the heating of the image fixing roller 10 is initiated by the heat exothermically liberated from the first exothermic phase transition material, so that the exothermic heating by the second exothermic phase transition material and that by the first exothermic phase transition material overlap, and the heat liberated from the second exothermic phase transition material can be best used for the heating of the first exothermic phase transition material to induce the exothermic liberation of heat therefrom.

In the above, it is preferable to heat the second exothermic phase transition material to the crystallization initiation temperature Tci2 thereof, although it is more preferable to heat the first exothermic phase transition material to the crystallization initiation temperature Tci1 thereof.

With reference to the diagram in FIG. 5, symbol I indicates the temperature difference between the crystallization initiation temperature Tci1 of the first exothermic phase transition material and the crystallization initiation temperature Tci2 of the second exothermic phase transition material; symbol II indicates the temperature difference between the crystallization initiation temperature Tci1 of the first exothermic phase transition material and the exothermic peak temperature Tcp2 of the second exothermic phase transition material; symbol III indicates the temperature difference between the exothermic peak temperature Tcp1 of the first exothermic phase transition material and the exothermic peak temperature Tcp2 of the second exothermic phase transition material; and symbol IV indicates the temperature difference between the crystallization initiation temperature Tci2 and the exothermic peak temperature Tcp2 of the second exothermic phase transition material. A portion E of the temperature elevation characteristic curve D which is above the image fixing possible temperature indicates overshooting temperature elevation.

When this overshooting temperature elevation is excessive, proper toner image fixing cannot always be carried out. Therefore it is preferable that the exothermic peak temperature Tcp1 of the first exothermic phase transition material be close to the image fixing possible temperature. In any of examples of the present invention which will be explained later, the overshooting temperature elevation was not excessive and substantially caused no problems. The operation of the heater 14 is controlled so as to maintain the image fixing possible temperature, usually in such a manner that the surface of the image fixing roller 10 is maintained at a temperature slightly lower than the image fixing possible temperature.

In order to utilize the thermal energy liberated from the two exothermic phase transition materials when the phase transition from an amorphous state to a crystalline solid state is carried out, the two exothermic phase transition materials are once fused. When fusing the two exothermic phase transition materials, the two materials are heated to a temperature higher than any of the melting point Tm1 of the first exothermic phase transition material and the melting point Tm2 of the second exothermic phase transition material. This is because even though the exothermic peak temperature Tcp2 of the second exothermic phase transition material is lower than the exothermic peak temperature Tcp1 of the first exothermic phase transition material, the melting point Tm2 of the second exothermic phase transition material is not always lower than the melting point Tm1 of the first exothermic phase transition material. In other words, there may be a case where although the exothermic peak temperature Tcp2 of the second exothermic phase transition material is lower than the exothermic peak temperature Tcp1 of the first exothermic phase transition material, the melting point Tm2 of the second exothermic phase transition material is higher than the melting point Tm1 of the first exothermic phase transition material.

For example, a SeTe alloy containing 8 wt. % of Te has a crystallization initiation temperature Tci of 100° C., an exothermic peak temperature Tcp of 150° C., and a melting point Tm of 230° C., while a SeTe alloy containing 50 wt. % of Te has a crystallization initiation temperature Tci of 90° C., an exothermic peak temperature Tcp of 110° C., and a melting point Tm of 280° C., so that when the SeTe alloy containing 8 wt. % of Te is used as the first exothermic phase transition material and the SeTe alloy containing 50 wt. % of Te is used as the second exothermic phase transition material, although the crystallization initiation temperature Tci1 is between the crystallization initiation temperature Tci2 and the exothermic peak temperature Tcp2, Tm2 is higher than Tm1, with the relation between the melting points Tm1 and Tm2 being reversed.

The two exothermic phase transition materials perform the phase transition from a fused state to an amorphous state by the rapid cooling. In this case, the cooling is performed at the cooling rate suitable for the phase transition from the fused state to the amorphous solid state of the exothermic phase transition material having the higher melting point. By this rapid cooling, each of the exothermic phase transition materials is subjected to the phase transition from the fused state to the amorphous solid state.

In order to improve the phase transition from the fused state to the amorphous state of the two exothermic phase transition materials, it is preferable that the cooling rate be switched to such a cooling rate at which the exothermic phase transition material having the lower melting point Tm is efficiently cooled, at a temperature near the freezing point of the exothermic phase transition material having the lower melting point Tm (the freezing point is almost the same as the melting point Tm thereof), since the cooling rate for the efficient phase transition to the amorphous state of each exothermic phase transition material differs, and the phase transition to the amorphous state of the exothermic phase transition material having the higher melting point Tm is substantially completed at the temperature near the freezing point of the exothermic phase transition material having the lower melting point Tm.

Alternatively the cooling may be performed at the greater cooling rate of (a) the cooling rate at which the first exothermic phase transition material is subjected to the phase transition from the fused state to the amorphous solid state and (b) the cooling rate at which the second exothermic phase transition material is subjected to the phase transition from the fused state to the amorphous solid state, whereby the phase transition from the fused state to the amorphous solid state of the exothermic phase transition materials can be speedily carried out. Even in this case, the phase transition of each exothermic phase transition material can be carried out efficiently by switching the cooling rate at a temperature near the freezing point of the exothermic phase transition material with the lower melting point.

After the completion of the phase transition, the cooling performed by a cooling fan which will be described later is terminated. The temperatures of the exothermic phase transition materials then become the same temperature as the ambient temperature.

In FIG. 5, F indicates the quick cooling rate, and G indicates the slow cooling rate. When the heat is exothermically liberated from the exothermic phase transition materials again, the image fixing roller 10 is heated again, using the heater 14.

FIG. 7 to FIG. 10 show specific examples of control systems for fusing the exothermic phase transition materials with the application of heat thereto and then cooling the fused exothermic phase transition materials.

Figure 7:
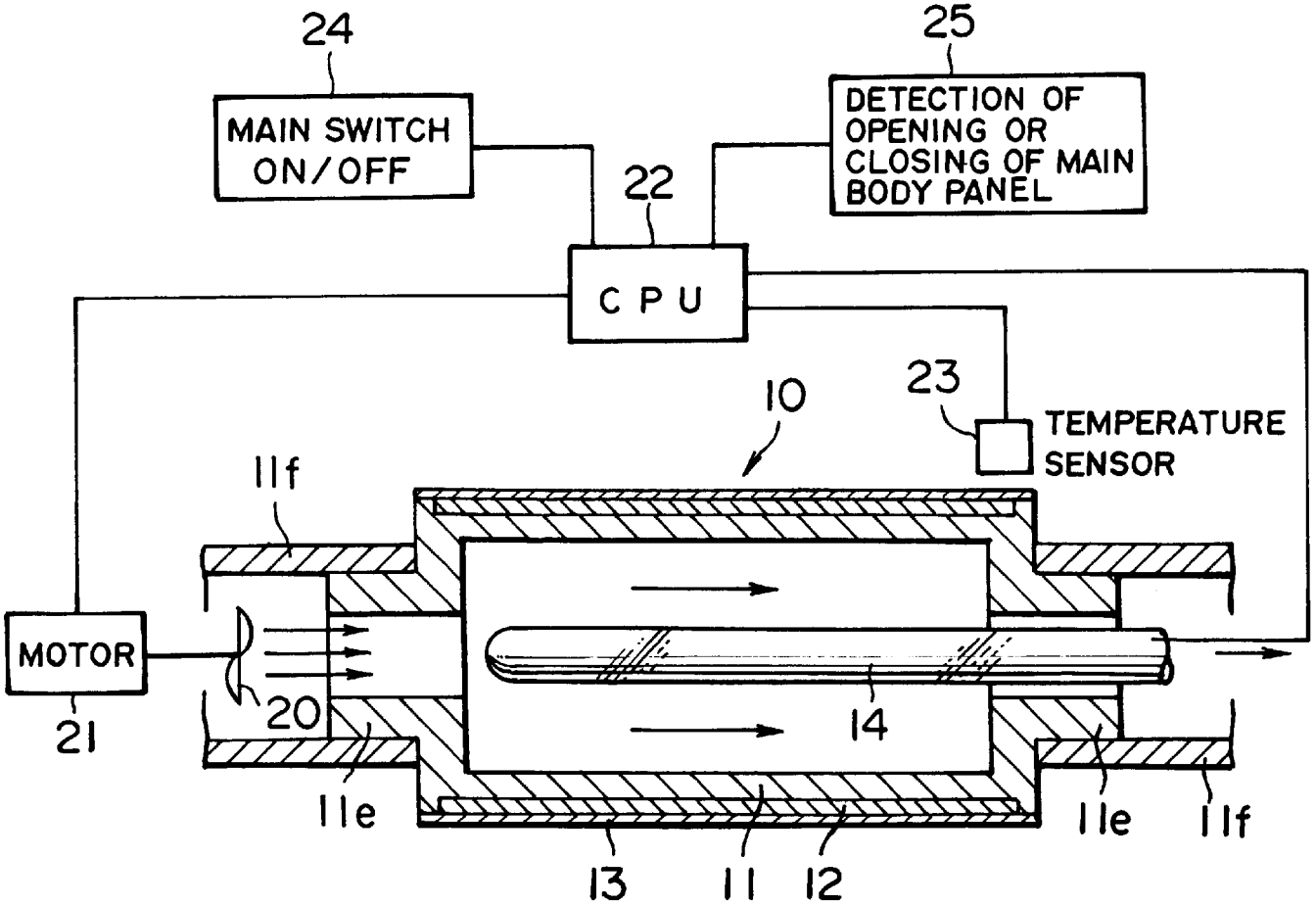
FIG. 7 is a diagram in explanation of the controlled operation of an image fixing apparatus of the present invention.

As shown in FIG. 7, the hollow core metal 11 is rotatably supported by a supporting cylinder 11*f*. A blower 20 is directed to the hollow core metal 11. The blower 20 is driven b a motor 21. The blower 20 and the motor 21 constitute a cooling section. The heater 14 is composed of a halogen lamp and functions as a heating section for heating the exothermic phase transition layer 12, and also as a fusing section for fusing the crystallized exothermic phase transition materials in the exothermic phase transition layer 12. The heater 14 and the motor 21 are controlled by a control section (CPU) 22. To the control section 22 are connected a temperature sensor 23, a main switch 24, and an opening and closing detection switch 25 for a main body panel (not shown). The temperature sensor 23 detects the surface temperature of the image fixing roller 10.

When the main switch 24 is turned ON, the control section 22 initiates supplying electric power to the heater 14 to energize the same, so that the image fixing roller 10 is heated, whereby exothermic liberation of heat is initiated from each exothermic phase transition material at each crystallization initiation temperature. Thus, the temperature of the image fixing roller 10 is rapidly elevated to the image fixing possible temperature.

The control section 22 controls the power supply to the heater 14, using the temperature sensor 23, in such a manner that the surface temperature of the image fixing roller 10 is maintained at the image fixing possible temperature. When the main switch 24 is turned OFF or the main body panel is opened, the control section 22 increases the power supply to the heater 14 in order to fuse the exothermic phase transition materials.

Figure 8:
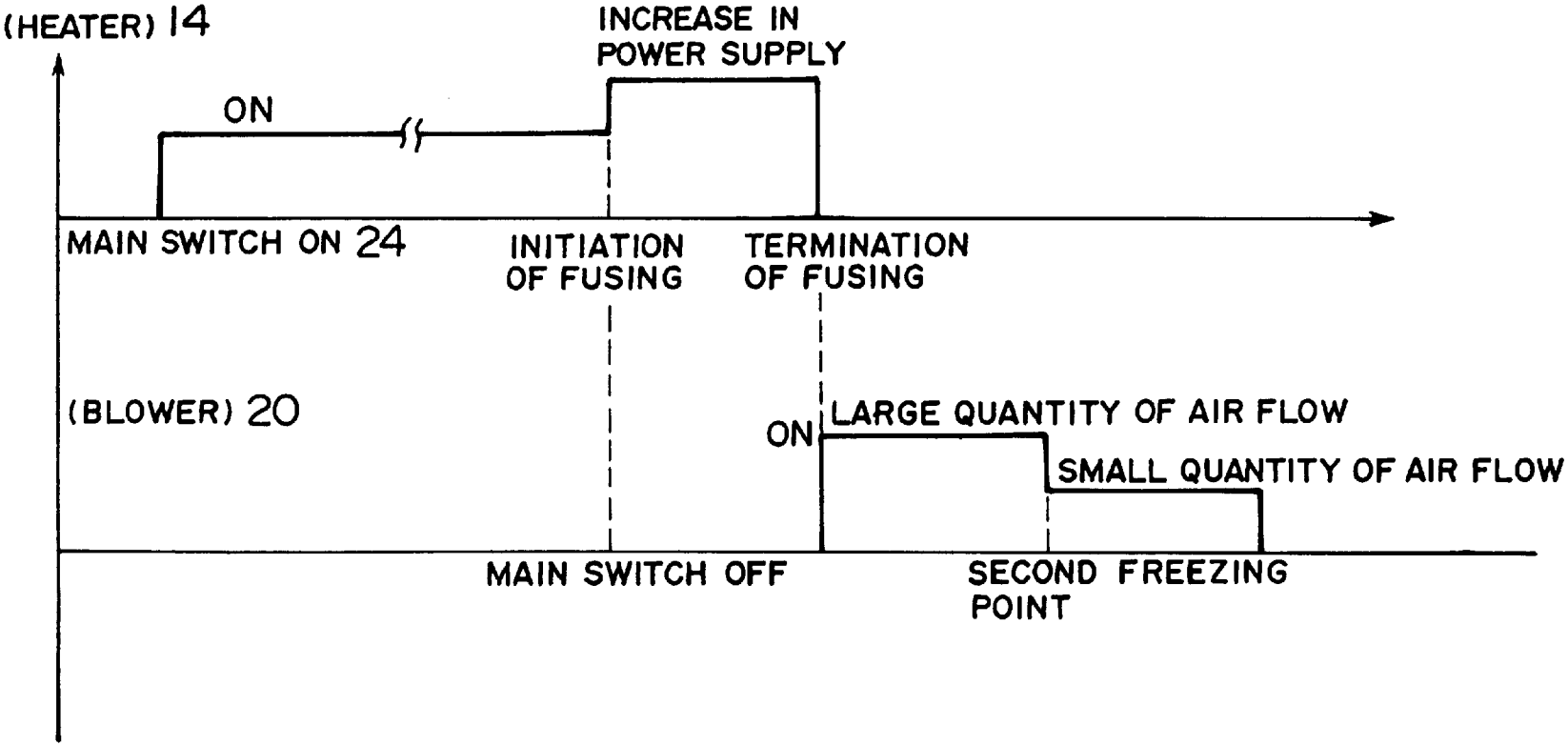
FIG. 8 is a diagram in explanation of the timing of the control of the image fixing apparatus of the present invention shown in FIG. 7.

The temperature sensor 23 determines whether or not the exothermic phase transition materials are fused by detecting the surface temperature of the image fixing roller 10. The control section 22 stops the power supply to the heater 14 in accordance with the determination of the fusing of the exothermic phase transition materials by the temperature sensor 23. At the same time or in a predetermined period of time, the control section 22 drives the motor 21 in rotation to initiate the cooling of the exothermic phase transition materials. When the cooling rate is changed by the control section 22, that change is conducted when the surface temperature of the image fixing roller 10 is determined to reach a temperature near the freezing point of the exothermic phase transition material with the lower melting point by the temperature sensor 23. The control section 22 stops the air blowing when each exothermic phase transition material becomes amorphous in a solid state. FIG. 8 shows a diagram in explanation of the timing of the power supply control. Such control can also be applied to mode 2 and mode 3 in Examples of the present invention which will be explained later.

When the main switch 24 is turned ON or the main body panel is closed, the control section 22 again initiates supplying power to the heater, so that the temperature of the image fixing roller 10 is rapidly elevated to the image fixing possible temperature. In this example, the heating and the fusing are conducted, using the heater 14 only, but a heating section and a fusing section may be separately provided. Furthermore, in this example, the heater 14 has such a structure that heats the core metal 11, but may be constructed so as to heat the exothermic phase transition layer 12 directly.

Figure 9:
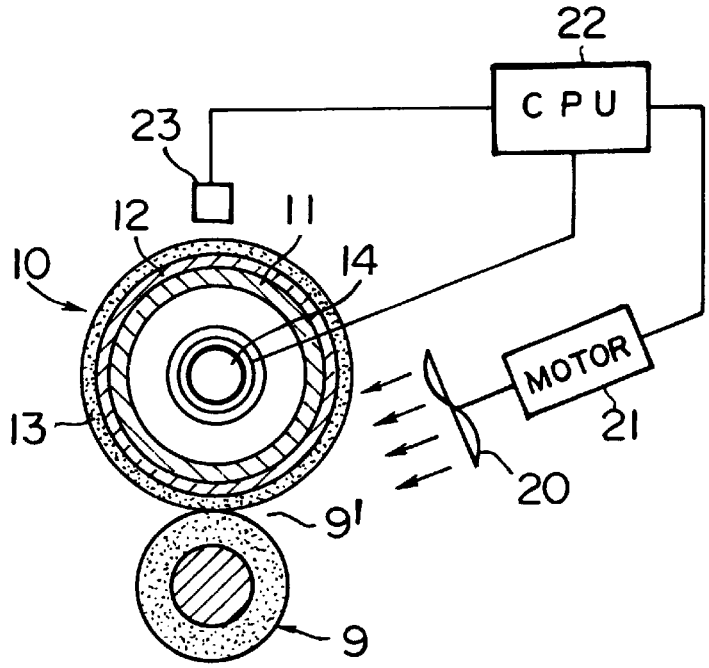
FIG. 9 is a diagram in explanation of a structure for cooling an outer peripheral surface of an image fixing roller of the present invention.

In FIG. 7, the structure is such that the inside of the exothermic phase transition layer 12 is cooled. Alternatively, as shown in FIG. 9, the outside of the exothermic phase transition layer 12 may be cooled, using the blower 20. In this case, it is preferable to direct the current of air to the nip 9' in order to prevent the deformation of the image fixing roller 10.

Figure 10:
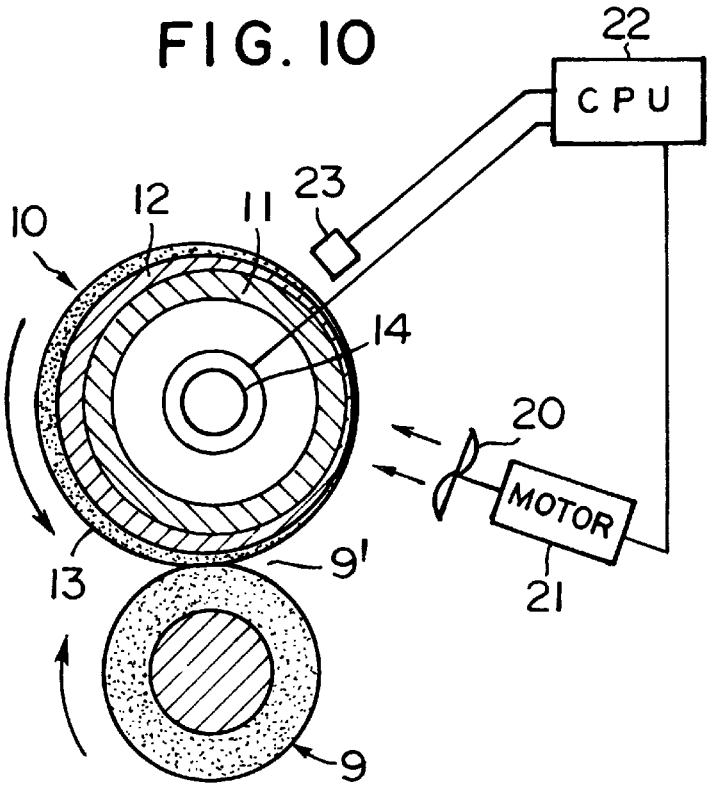
FIG. 10 is a diagram in explanation of the operation of the cooling structure as the image fixing roller is rotated in FIG. 9.

Furthermore, as shown in FIG. 10, when the fusing and the cooling are successively performed as the image fixing roller 10 is rotated, the pressure application roller 9 applies pressure uniformly to the outer peripheral surface of the image fixing roller 10, so that the thickness of the exothermic phase transition layer 12 can be maintained uniform after the fusing and the cooling.

Other features of this invention will become apparent in the course of the following description of exemplary embodiments, which are given for illustration of the invention and are not intended to be limiting thereof, and comparative examples.

Examples of image fixing rollers in embodiment mode 1 of the present invention, in which the exothermic phase transition layer 12 comprises a mixture of the first phase transition material and the second phase transition material, will now be explained with reference to comparative examples corresponding thereto.

EXAMPLE 1-1

In a vacuum deposition chamber, two vacuum evaporation sources were placed, with a SeTe alloy containing 8 wt. % of Te being placed in one of the two vacuum evaporation sources, and a diphenyl isophthalate derivative (with a molecular weight of about 600, m.p. 210° C.) in the other vacuum evaporation source.

A cylindrical core metal 11 made of an aluminum allow with an outer diameter of 20 mm was also placed in the vacuum deposition chamber, and the SeTe alloy and the diphenyl isophthalate derivative were simultaneously vacuum deposited under the application of heat thereto onto the outer surface of the cylindrical core metal 11, with the application of electric power to the two vacuum evaporation sources, whereby an exothermic phase transition layer 12 with a thickness of 60 $\mu$m was formed on the outer surface of the cylindrical core metal 11.

The exothermic phase transition layer 12 was covered with a heat-shrinkable tubing made of tetrafluoroethylene—perfluoroalkyl vinyl ether copolymer (hereinafter referred to as PFA) as a protective layer 13 for the exothermic phase transition layer 12, sealed, heated to 250° C., and then rapidly cooled at a cooling rate of 10° C. or more per minute, whereby an exothermic image fixing roller 10 of the present invention was fabricated, which is referred to as Sample No. 1-1 in TABLE 2.

EXAMPLE 1-2

In a vacuum deposition chamber, two vacuum evaporation sources were placed, with a diphenyl isophthalate derivative (with a molecular weight of about 600, m.p. 210° C.) being placed in one of the two vacuum evaporation sources, and a trimer to pentamer of a diphenyl carbonate adduct bisphenol A derivative (with a molecular weight of about 800, m.p. 215° C.) in the other vacuum evaporation source.

A cylindrical core metal 11 made of an aluminum alloy with an outer diameter of 20 mm was also placed in the vacuum deposition chamber, and the diphenyl isophthate derivative and the diphenyl carbonate adduct bisphenol A derivative were simultaneously vacuum deposited under the application of heat thereto onto the outer surface of the cylindrical core metal 11, with the application of electric power to the two vacuum evaporation sources, whereby an exothermic phase transition layer 12 with a thickness of 60 $\mu$m was formed on the outer surface of the cylindrical core metal 11.

The exothermic phase transition layer 12 was covered with a heat-shrinkable tubing made of PFA as a protective layer 13 for the exothermic phase transition layer 12, sealed, heated to 230° C., and then rapidly cooled at a cooling rate of 10° C. or more per minute, whereby an exothermic image fixing roller 10 of the present invention was fabricated, which is referred to as Sample No. 1-2 in TABLE 2.

EXAMPLE 1-3

A pulverized PET and a pulverized SeTe alloy containing 50 wt. % of Te were mixed in a parts-by-weight ratio of 1:1.

This pulverized mixture was coated on the outer peripheral surface of a cylindrical core metal 11 made of an aluminum alloy with an outer diameter of 20 mm by electrostatic coating, whereby an exothermic phase transition layer 12 with a thickness of 60 μm was formed on the outer peripheral surface of the cylindrical core metal 11.

The exothermic phase transition layer 12 was then rapidly heated to about 150° C., and at the stage where the alloy was crystallized and fused to the cylindrical core metal 11, the exothermic phase transition layer 12 was covered with a heat-shrinkable tubing made of PFA as a protective layer 13 for the exothermic phase transition layer 12, sealed, heated to 285° C. under reduced pressure, and then rapidly cooled at a cooling rate of 50° C. or more per minute, whereby an exothermic image fixing roller 10 of the present invention was fabricated, which is referred to as Sample No. 1-3 in TABLE 2.

COMPARATIVE EXAMPLE 1-1-1

In a vacuum deposition chamber, a vacuum evaporation source which held therein a SeTe alloy containing 8 wt. % of Te was placed, and a cylindrical core metal 11 of an aluminum alloy with an outer diameter of 20 mm were placed.

The SeTe alloy was vacuum deposited under the application of heat thereto onto the outer surface of the cylindrical core metal 11, with the application of electric power to the vacuum evaporation source, whereby an exothermic phase transition layer 12 with a thickness of 60 μm was formed on the outer surface of the cylindrical core metal 11.

The exothermic phase transition layer 12 was covered with a heat-shrinkable tubing made of PFA as a protective layer 13 for the exothermic phase transition layer 12, sealed, heated to 250° C., and then rapidly cooled at a cooling rate of 10° C. or more per minute, whereby a comparative exothermic image fixing roller was fabricated, which is referred to as Comparative Sample No. 1-1-1 in TABLE 2.

COMPARATIVE EXAMPLE 1-1-2

In a vacuum deposition chamber, a vacuum evaporation source which held therein a diphenyl isophthalate derivative (with a molecular weight of about 600, m.p. 210° C.), and a cylindrical core metal 11 made of an aluminum alloy with an outer diameter of 20 mm were placed.

The diphenyl isophthalate derivative was vacuum deposited under the application of heat thereto onto the outer surface of the cylindrical core metal 11, with the application of electric power to the vacuum evaporation source, whereby an exothermic phase transition layer 12 with a thickness of 60 μm was formed on the outer surface of the cylindrical core metal 11.

The exothermic phase transition layer 12 was covered with a heat-shrinkable tubing made of PFA as a protective layer 13 for the exothermic phase transition layer 12, sealed, heated to 250° C., and then rapidly cooled at a cooling rate of 10° C. or more per minute, whereby a comparative exothermic image fixing roller was fabricated, which is referred to as Comparative Sample No. 1-1-2 in TABLE 2.

COMPARATIVE EXAMPLE 1-1-3

In a vacuum deposition chamber, a vacuum evaporation source which held therein a trimer to pentamer of a diphenyl carbonate adduct bisphenol A derivative (with a molecular weight of about 800, m.p. 215° C.), and a cylindrical core metal 11 made of an aluminum alloy with an outer diameter of 20 mm were placed.

The diphenyl carbonate adduct bisphenol A derivative was vacuum deposited under the application of heat thereto onto the outer surface of the cylindrical core metal 11, with the application of electric power to the vacuum evaporation source, whereby an exothermic phase transition layer 12 with a thickness of 60 μm was formed on the outer surface of the cylindrical core metal 11.

The exothermic phase transition layer 12 was covered with a heat-shrinkable tubing made of PFA as a protective layer 13 for the exothermic phase transition layer 12, sealed, heated to 250° C., and then rapidly cooled at a cooling rate of 10° C. or more per minute, whereby a comparative exothermic image fixing roller was fabricated, which is referred to as Comparative Sample No. 1-1-3 in TABLE 2.

COMPARATIVE EXAMPLE 1-1-4

A curled PET film, which was curled by preliminarily heating a PET film to 180° C. to 200° C., was applied to the outer peripheral surface of a cylindrical core metal 11 made of an aluminum alloy with an outer diameter of 20 mm, whereby an exothermic phase transition layer 12 with a thickness of 60 μm was formed on the outer peripheral surface of the cylindrical core metal 11.

The exothermic phase transition layer 12 was covered with a heat-shrinkable tubing made of PFA as a protective layer 13 for the exothermic phase transition layer 12, sealed, heated to 230° C., and then rapidly cooled at a cooling rate of 50° C. or more per minute, whereby a comparative exothermic image fixing roller was fabricated, which is referred to as Comparative Sample No. 1-1-4 in TABLE 2.

COMPARATIVE EXAMPLE 1-1-5

A pulverized SeTe alloy containing 50 wt. % of Te was coated on the outer peripheral surface of a cylindrical core metal 11 made of an aluminum alloy with an outer diameter of 20 mm by electrostatic coating, whereby an exothermic phase transition layer 12 with a thickness of 60 μm was formed on the outer peripheral surface of the cylindrical core metal 11.

The exothermic phase transition layer 12 was then rapidly heated to about 150° C., and at the stage where the alloy was crystallized and fused to the cylindrical core metal 11, the exothermic phase transition layer 12 was covered with a heat-shrinkable tubing made of PFA as a protective layer 13 for the exothermic phase transition layer 12, sealed, heated to 230° C., and then rapidly cooled at a cooling rate of 50° C. or more per minute, whereby a comparative exothermic image fixing roller was fabricated, which is referred to as Comparative Sample No. 1-1-5 in TABLE 2.

COMPARATIVE EXAMPLE 1-2

In a vacuum deposition chamber, two vacuum evaporation sources were placed, with a SeTe alloy containing 50 wt. % of Te being placed in one of the two vacuum evaporation sources, and Se in the other vacuum evaporation source.

A cylindrical core metal 11 made of an aluminum alloy with an outer diameter of 20 mm was also placed in the vacuum deposition chamber, and the SeTe alloy and the Se were vacuum deposited under the application of heat thereto onto the outer surface of the cylindrical core metal 11, with the application of electric power to the two vacuum evaporation sources, whereby an exothermic phase transition layer 12 with a thickness of 60 μm was formed on the outer surface of the cylindrical core metal 11.

The exothermic phase transition layer 12 was then rapidly heated to about 150° C., and was then covered with a heat-shrinkable tubing made of PFA as a protective layer 13 for the exothermic phase transition layer 12, sealed, heated to 285° C. under reduced pressure, and then rapidly cooled at a cooling rate of 50° C. or more per minute, whereby a comparative exothermic image fixing roller was fabricated, which is referred to as Comparative Sample No. 1-2 in TABLE 2.

COMPARATIVE EXAMPLE 1-3

In a vacuum deposition chamber, two vacuum evaporation sources were placed, with the same trimer to pentamer of the diphenyl carbonate adduct bisphenol A derivative (with a molecular weight of about 800, m.p. 215° C.) as used in Example 1-2 being placed in one of the two vacuum evaporation sources, and a bisphenol A derivative in the other vacuum evaporation source.

A cylindrical core metal 11 made of an aluminum alloy with an outer diameter of 20 mm was also placed in the vacuum deposition chamber, and the diphenyl carbonate adduct bisphenol A derivative and the bisphenol A derivative were simultaneously vacuum deposited under the application of heat thereto onto the outer surface of the cylindrical core metal 11, with the application of electric power to the two vacuum evaporation sources, whereby an exothermic phase transition layer 12 with a thickness of 60 $\mu$m was formed on the outer surface of the cylindrical core metal 11.

The exothermic phase transition layer 12 was covered with a heat-shrinkable tubing made of PFA as a protective layer 13 for the exothermic phase transition layer 12, sealed, heated to 230° C., and then rapidly cooled at a cooling rate of 10° C. or more per minute, whereby a comparative exothermic image fixing roller was fabricated, which is referred to as Comparative Sample No. 1-3 in TABLE 2.

Each of these image fixing rollers of Samples Nos. 1-1, 1-2 and 1-3 of the present invention and Comparative Samples Nos. 1-1-1 to 1-1-5, No. 1-2 and No. 1-3 was incorporated into the image fixing apparatus of a commercially available electrophotographic copying machine (Trademark M210 made by Ricoh Company, Ltd.) and the elevation of the surface temperature of each image fixing roller was investigated under the application of electric power of 960 W to the heater. The results are shown in TABLE 2.

TABLE 2

| Sample No. | Structure of Exothermic Phase Transition Layer | Elevation of Surface Temperature of Image Fixing Roller | Stability in Repeated Use |
|---|---|---|---|
| Sample No. 1-1 | D/A | Two temperature elevation peaks with quick elevation to image fixing temperature | No changes |
| Sample No. 1-2 | B/A | ditto | No changes |
| Sample No. 1-3 | C/E | ditto | No changes |
| Comp. Sample No. 1-1-1 | A | Single temperature elevation peak with slow elevation to image fixing temperature | No changes |
| Comp. Sample No. 1-1-2 | B | ditto | No changes |
| Comp. Sample No. 1-1-3 | C | ditto | No changes |
| Comp. Sample No. 1-1-4 | D | ditto | No changes |
| Comp. Sample No. 1-1-5 | E | ditto | No changes |
| Comp. Sample No. 1-2 | E/F | Two temperature elevation peaks with quick elevation to image fixing temperature | Peak temperature changed |
| Comp. Sample No. 1-3 | B/G | ditto | Peak temperature changed |

A: Diphenyl isophthalate derivative
B: Diphenyl carbonate adduct bisphenol A derivative
C: Polyethylene terephthalate
D: SeTe alloy containing 8 wt. % of Te
E: SeTe alloy containing 50 wt. % of Te
F: Se
G: Bisphenol A derivative In each of Samples Nos. 1-1 to 1-3 of the present invention, as shown in FIG. 5, the temperature elevation of the surface of the image fixing roller 10 was in a composite form composed of the two exothermic temperature elevation patterns of the two exothermic phase transition materials, and the temperature of the surface of the image fixing roller 10 was rapidly increased at the crystallization initiation temperature Tci2 of the second exothermic phase transition material and then continuously elevated.

In contrast to this, when only the second exothermic phase transition material was employed, the crystallization initiation temperature Tci2 of the second exothermic phase transition material was so low that the temperature elevation effect thereof was not conspicuous near the image fixing possible temperature, while when only the first exothermic phase transition material was employed, the temperature elevation was delayed to such a degree that corresponded to the high crystallization initiation temperature Tci1 of the first exothermic phase transition material as in Comparative Samples Nos. 1-1-1 to 1-1-5.

Furthermore, when the first and second exothermic phase transition materials were employed, but the two exothermic phase transition materials had similar characteristics as in Comparative Samples No. 1-2 and No. 1-3, the temperature elevation effects by the respective exothermic phase transition materials were initially observed, but in the course of the repeated use, the crystallization initiation temperatures of the respective exothermic phase transition materials changed, the operation of the image fixing rollers became unstable.

In the present invention, the exothermic phase transition layer may be composed of a mixture of three or more different kinds of exothermic phase transition materials.

In the image fixing rollers of Samples Nos. 1-1, 1-2 and 1-3 of the present invention, the respective exothermic phase transition layers 12 thereof were composed of two kinds of exothermic phase transition materials, each having particular effects of elevating the surface temperature of the image fixing roller more rapidly than by using the heater 14 only, so that by the heat exothermically liberated from the exothermic phase transition layer 12, the surface temperature of the image fixing roller 10 was rapidly increased stepwise, starting from a relatively low temperature, and the warm-up time the image fixing roller 10 was significantly shortened, and the electric power for the heater 14 was notably saved.

Furthermore, since the exothermic phase transition layer 12 can be composed of a mixture of a plurality of exothermic phase transition materials with different crystallization temperature characteristics such as crystallization initiation temperature and exothermic peak temperature, the temperature elevation range thereof can be easily set from a wide range from room temperature to the image fixing possible temperature in which the copying machine by appropriately combining the exothermic phase transition materials.

In the above-mentioned embodiment mode 1, in which the exothermic phase transition layer 12 comprises a mixture of the first phase transition material and the second phase transition material.

In the following embodiment mode 2, the exothermic phase transition layer 12 comprises a first component exothermic phase transition layer comprising a first exothermic phase transition material and a second component exothermic phase transition layer comprising a second exothermic phase transition material. The function of the exothermic phase transition layer 12 of the embodiment mode 2 is substantially the same as the function of the exothermic phase transition layer 12 of the above-mentioned embodiment mode 1.

Figure 11:
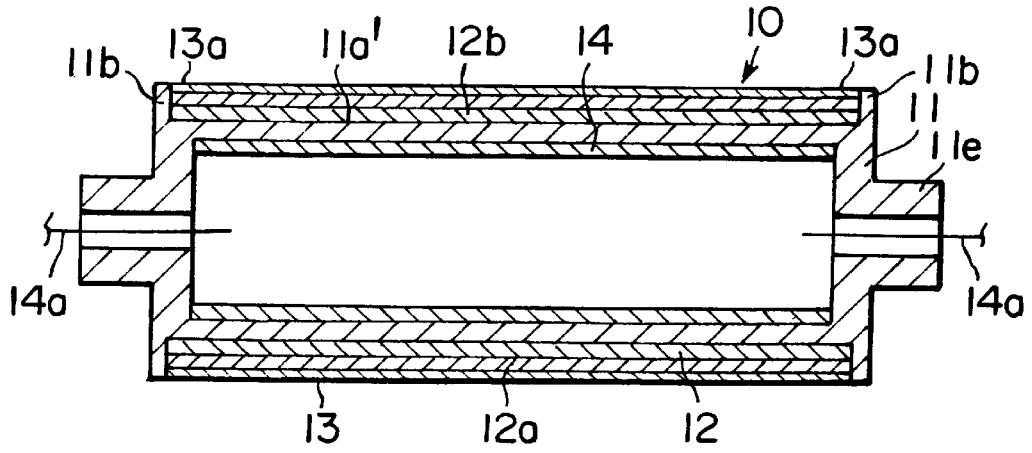
FIG. 11 is a schematic enlarged cross-sectional view of an image fixing roller of the present invention which comprises an exothermic phase transition layer comprising a first layer and a second layer.

With reference to FIG. 11, the exothermic phase transition layer 12 is composed of a first component exothermic phase transition layer 12*a* (hereinafter referred to as the first layer 12*a*) and a second component exothermic phase transition layer 12*b* (hereinafter referred to as the second layer 12*b*), and the exothermic phase transition layer 12 is covered with a protective layer 13. In this example, the first layer 12*a* consists of a first exothermic phase transition material and the second layer 12*b* consists of a second exothermic phase transition material. The first layer 12*a* is overlaid on the second layer 12*b*. The first exothermic phase transition material for the first layer 12*a* has a first crystallization initiation temperature, and the second exothermic phase transition material for the second layer 12*b* has a second crystallization initiation temperature, and the first crystallization initiation temperature is higher than the second crystallization initiation temperature.

Figure 12:
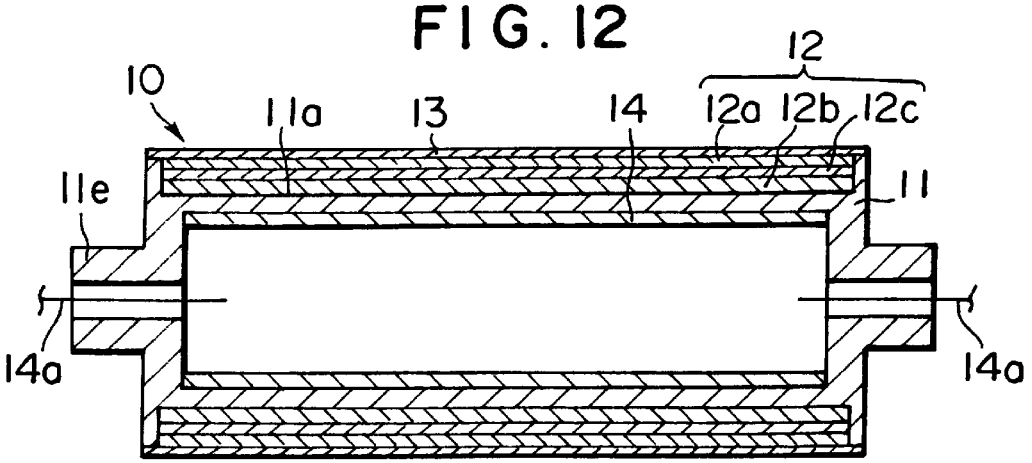
FIG. 12 is a schematic enlarged cross-sectional view of an image fixing roller of the present invention which comprises an exothermic phase transition layer comprising a first layer, a second layer and a third layer.

As shown in FIG. 12, the exothermic phase transition layer 12 may further comprise, between the first layer 12*a* and the second layer 12*b*, a third layer 12*c* consisting of an exothermic phase transition material having a crystallization initiation temperature which is between the first crystallization initiation temperature and the second crystallization initiation temperature.

Figure 13:
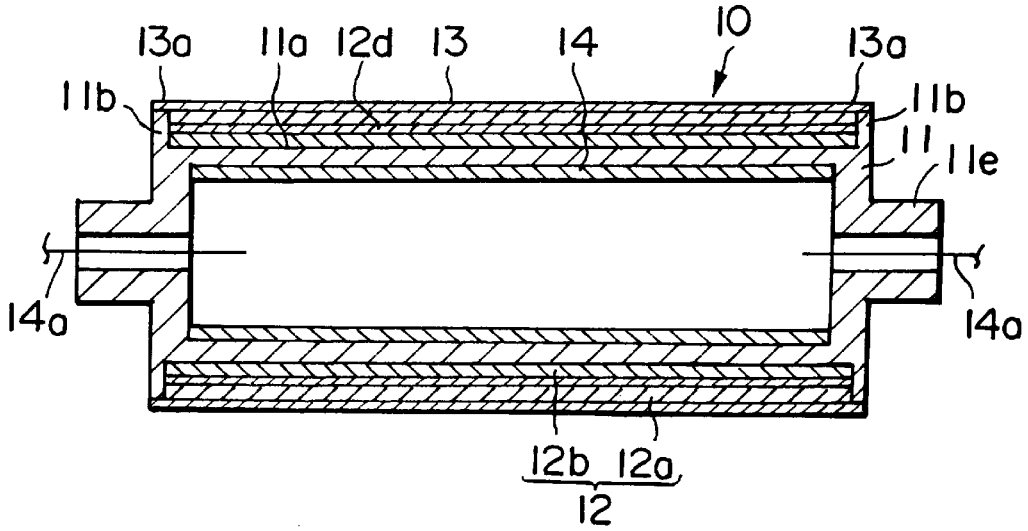
FIG. 13 is a schematic enlarged cross-sectional view of an image fixing roller of the present invention which comprises an exothermic phase transition layer comprising a first layer and a second layer, including a barrier layer interposed between the first layer and the second layer.

Furthermore, as shown in FIG. 13, a barrier layer 12*d* composed of a material having high thermal conductivity, such as aluminum, may be interposed between the second layer 12*b* and the first layer 12*a*. It is preferable that the barrier layer 12*d* have a melting point higher than any of the melting point Tm1 of the first exothermic phase transition material and the melting point Tm2 of the second exothermic phase transition material, so that these exothermic phase transition materials are not mixed when fused. It is also preferable to use the above-mentioned barrier layer 12*d* when the first and second exothermic phase transition materials are compatible, that is, soluble in each other.

As the exothermic phase transition materials for use in the above-mentioned first layer 12*a* and second layer 12*b*, the same exothermic phase transition materials for use in the above-mentioned embodiment mode 1, for example, those shown in TABLE 1, can be employed.

Examples of image fixing rollers in embodiment mode 2 of the present invention, in which the exothermic phase transition layer 12 comprises a first component exothermic phase transition layer comprising a first exothermic phase transition material and a second component exothermic phase transition layer comprising a second exothermic phase transition material, will now be explained with reference to comparative examples corresponding thereto.

EXAMPLE 2-1

On an outer peripheral surface of a cylindrical core metal 11 made of an aluminum alloy with an outer diameter of 20 mm, a coating liquid dispersion of a diphenyl isophthalate derivative was coated and dried, whereby a second layer 12*b* was formed on the outer surface of the aluminum alloy core metal 11.

In a vacuum deposition chamber, the aluminum alloy core metal 11 provided with the above-mentioned second layer 12*b* and a vacuum evaporation source for a SeTe alloy containing 8 wt. % of Te were placed.

The SeTe alloy was then vacuum deposited under the application of heat thereto onto the first layer 12*a*, with the application of electric power to the vacuum evaporation source, whereby a first layer 12*a* made of the SeTe alloy was formed on the second layer 12*b*.

Thus, an exothermic phase transition layer 12 with a thickness of 60 $\mu$m composed of the first layer 12*a* and the second layer 12*b* was formed on the core metal 11.

The exothermic phase transition layer 12 was then covered with a heat-shrinkable-tubing made of PFA as a protective layer 13 for the exothermic phase transition layer 12, sealed, heated to 250° C., and then rapidly cooled at a cooling rate of 10° C. or more per minute, whereby an exothermic image fixing roller 10 of the present invention was fabricated, which is referred to as Sample No. 2-1 in TABLE 3.

EXAMPLE 2-2

In a vacuum deposition chamber, two vacuum evaporation sources were placed, with a diphenyl isophthalate derivative (with a molecular weight of about 600, m.p. 210° C.) being placed in one of the two vacuum evaporation sources, and a trimer to pentamer of a diphenyl carbonate adduct bisphenol A derivative (with a molecular weight of about 800, m.p. 215° C.) in the other vacuum evaporation source.

A cylindrical core metal 11 made of an aluminum alloy with an outer diameter of 20 mm was also placed in the vacuum deposition chamber.

The diphenyl isophthate derivative was first vacuum deposited under the application of heat thereto onto the outer surface of the cylindrical core metal 11, with the application of electric power to the vacuum evaporation source, to form a second layer 12*b* on the cylindrical core metal 11, and then the diphenyl carbonate adduct bisphenol A derivative was vacuum deposited under the application of heat thereto onto the second layer 12*b*, with the application of electric power to the vacuum evaporation source to form a first layer 12*a* on the second layer 12*b*, whereby an exothermic phase transition layer 12 with a thickness of 60 $\mu$m was formed on the outer surface of the cylindrical core metal 11.

The exothermic phase transition layer 12 was covered with a heat-shrinkable tubing made of PFA as a protective layer 13 for the exothermic phase transition layer 12, sealed, heated to 220° C., and then rapidly cooled at a cooling rate of 10° C. or more per minute, whereby an exothermic image fixing roller 10 of the present invention was fabricated, which is referred to as Sample No. 2-2 in TABLE 3.

EXAMPLE 2-3

On an outer peripheral surface of a cylindrical core metal 11 made of an aluminum alloy with an outer diameter of 20 mm, a second layer 12*b* made of a PET film was formed by preheating a PET film to 180° C. to 200° C. to curl the PET film.

In a vacuum deposition chamber, the aluminum alloy core metal 11 provided with the above-mentioned second layer 12*b* made of the PET film and a vacuum evaporation source for a SeTe alloy containing 8 wt. % of Te were placed.

The SeTe alloy was then vacuum deposited under the application of heat thereto onto the second layer 12*b*, with the application of electric power to the vacuum evaporation source, whereby a first layer 12*a* made of the SeTe alloy was formed on the second layer 12*b*.

Thus, an exothermic phase transition layer 12 with a thickness of 60 μm composed of the first layer 12*a* and the second layer 12*b* was formed on the core metal 11.

The exothermic phase transition layer 12 was then covered with a heat-shrinkable tubing made of PFA as a protective layer 13 for the exothermic phase transition layer 12, sealed, heated to 285° C. under reduced pressure, and then rapidly cooled at a cooling rate of 50° C. or more per minute, whereby an exothermic image fixing roller 10 of the present invention was fabricated, which is referred to as Sample No. 2-3 in TABLE 3.

EXAMPLE 2-4

In a vacuum deposition chamber, a SeTe alloy containing 50 wt. % of Te was vacuum deposited on an outer peripheral surface of a cylindrical core metal 11 made of an aluminum alloy with an outer diameter of 20 mm to form a second layer 12*b* thereon.

A barrier layer 12*d* made of stainless steel was then formed on the surface of the second layer 12*b* by spattering.

On the barrier layer 12*d*, a SeTe alloy containing 8 wt. % of Te was vacuum deposited to form a first layer, whereby an exothermic phase transition layer 12 with a thickness of 60 μm composed of the first layer 12*a*, the barrier layer 12*d* and the second layer 12*b* was formed on the core metal 11.

The exothermic phase transition layer 12 was then covered with a heat-shrinkable tubing made of PFA as a protective layer 13 for the exothermic phase transition layer 12, sealed, heated to 285° C. under reduced pressure, and then rapidly cooled at a cooling rate of 10° C. or more per minute, whereby an exothermic image fixing roller 10 of the present invention was fabricated, which is referred to as Sample No. 2-4 in TABLE 3.

EXAMPLE 2-5

On an outer peripheral surface of a cylindrical core metal 11 made of an aluminum alloy with an outer diameter of 20 mm, a coating dispersion of a diphenyl isophthalate was coated and dried to form a second layer 12*b* on the outer surface of the aluminum alloy core metal 11.

A PET sheet laminated with an aluminum film (serving as a barrier layer 12*d*) was curled with the application of heat thereto to 180° C. to 200° C. by preliminary heat application, and was overlaid on the second layer 12*b* in such a manner that the aluminum film serving as the barrier layer 12*d* came into contact with the second layer 12*b*, whereby a first layer 12*a* made of the PET sheet was formed on the barrier layer 12*d* which was provided on the second layer 12*b*.

Thus, an exothermic phase transition layer 12 with a thickness of 60 μm composed of the first layer 12*a*, the barrier layer 12*d* and the second layer 12*b* was formed on the core metal 11.

The exothermic phase transition layer 12 was then covered with a heat-shrinkable tubing made of PFA as a protective layer 13 for the exothermic phase transition layer 12, sealed, heated to 250° C. under reduced pressure, and then rapidly cooled at a cooling rate of 50° C. or more per minute, whereby an exothermic image fixing roller 10 of the present invention was fabricated, which is referred to as Sample No. 2-5 in TABLE 3.

COMPARATIVE EXAMPLE 2-1-1

On an outer peripheral surface of a cylindrical core metal 11 made of an aluminum alloy with an outer diameter of 20 mm, a coating liquid dispersion of a diphenyl isophthalate derivative was coated and dried, whereby an exothermic phase transition layer 12 with a thickness of 60 μm was formed on the core metal 11.

The exothermic phase transition layer 12 was then covered with a heat-shrinkable tubing made of PFA as a protective layer 13 for the exothermic phase transition layer 12, sealed, heated to 250° C., and then rapidly cooled at a cooling rate of 10° C. or more per minute, whereby a comparative exothermic image fixing roller was fabricated, which is referred to as Comparative Sample No. 2-1-1 in TABLE 3.

COMPARATIVE EXAMPLE 2-1-2

In a vacuum deposition chamber, a cylindrical core metal 11 made of an aluminum alloy with an outer diameter of 20 mm, and a vacuum evaporation source for a SeTe alloy containing 8 wt. % of Te were placed.

The SeTe alloy was then vacuum deposited on the outer peripheral surface of the cylindrical core metal 11 under the application of heat thereto, with the application of electric power to the vacuum evaporation source, whereby a an exothermic phase transition layer 12 made of the SeTe alloy with a thickness of 60 μm was formed on the cylindrical core metal 11.

The exothermic phase transition layer 12 was then covered with a heat-shrinkable tubing made of PFA as a protective layer 13 for the exothermic phase transition layer 12, sealed, heated to 250° C., and then rapidly cooled at a cooling rate of 10° C. or more per minute, whereby an exothermic image fixing roller 10 of the present invention was fabricated, which is referred to as Sample No. 2-1-2 in TABLE 3.

COMPARATIVE EXAMPLE 2-2

In a vacuum deposition chamber, a cylindrical core metal 11 made of an aluminum alloy with an outer diameter of 20 mm, and a vacuum evaporation source for a trimer to pentamer of a diphenyl carbonate adduct bisphenol A derivative (with a molecular weight of about 800, m.p. 215° C.) were placed.

A cylindrical core metal 11 made of an aluminum alloy with an outer diameter of 20 mm was also placed in the vacuum deposition chamber.

The bisphenol A derivative was vacuum deposited under the application of heat thereto onto the outer surface of the cylindrical core metal 11, with the application of electric power to the vacuum evaporation source, whereby an exothermic phase transition layer 12 with a thickness of 60 μm was formed on the outer surface of the cylindrical core metal 11.

The exothermic phase transition layer 12 was covered with a heat-shrinkable tubing made of PFA as a protective layer 13 for the exothermic phase transition layer 12, sealed, heated to 220° C., and then rapidly cooled at a cooling rate of 10° C. or more per minute, whereby a comparative exothermic image fixing roller was fabricated, which is referred to as Comparative Sample No. 2-2 in TABLE 3.

COMPARATIVE EXAMPLE 2-3

On an outer peripheral surface of a cylindrical core metal 11 made of an aluminum alloy with an outer diameter of 20 mm, an exothermic phase transition layer 12 with a thickness of 60 μm made of a PET film was formed by preheating a PET film to 180° C. to 200° C. to curl the PET film.

The exothermic phase transition layer 12 was then covered with a heat-shrinkable tubing made of PFA as a protective layer 13 for the exothermic phase transition layer 12, sealed, heated to 285° C. under reduced pressure, and then rapidly cooled at a cooling rate of 50° C. or more per minute, whereby a comparative exothermic image fixing roller was fabricated, which is referred to as Comparative Sample No. 2-3 in TABLE 3.

COMPARATIVE EXAMPLE 2-4-1

In a vacuum deposition chamber, a SeTe alloy containing 50 wt. % of Te was vacuum deposited on an outer peripheral surface of a cylindrical core metal 11 made of an aluminum alloy with an outer diameter of 20 mm to form an exothermic phase transition layer 12 with a thickness of 60 μm on the core metal 11.

The exothermic phase transition layer 12 was then covered with a heat-shrinkable tubing made of PFA as a protective layer 13 for the exothermic phase transition layer 12, sealed, heated to 285° C. under reduced pressure, and then rapidly cooled at a cooling rate of 10° C. or more per minute, whereby a comparative exothermic image fixing roller was fabricated, which is referred to as Comparative Sample No. 2-4-1 in TABLE 3.

COMPARATIVE EXAMPLE 2-4-2

In a vacuum deposition chamber, a SeTe alloy containing 50 wt. % of Te was vacuum deposited on an outer peripheral surface of a cylindrical core metal 11 made of an aluminum alloy with an outer diameter of 20 mm to form a second layer 12*b* thereon.

On the second layer 12*b*, a SeTe alloy containing 8 wt. % of Te was vacuum deposited, whereby a first layer 12*a* was formed. Thus, an exothermic phase transition layer 12 with a thickness of 60 μm composed of the first layer 12*a*, and the second layer 12*b* was formed on the core metal 11.

The exothermic phase transition layer 12 was then covered with a heat-shrinkable tubing made of PFA as a protective layer 13 for the exothermic phase transition layer 12, sealed, heated to 285° C. under reduced pressure, and then rapidly cooled at a cooling rate of 10° C. or more per minute, whereby a comparative exothermic image fixing roller was fabricated, which is referred to as Comparative Sample No. 2-4-2 in TABLE 3.

COMPARATIVE EXAMPLE 2-5

On an outer peripheral surface of a cylindrical core metal 11 made of an aluminum alloy with an outer diameter of 20 mm, a coating dispersion of a diphenyl isophthalate was coated and dried to form a second layer 12*b* on the outer surface of the aluminum alloy core metal 11.

A PET sheet was curled with the application of heat thereto to 180° C. to 200° C. by preliminary heat application, and was overlaid on the second layer 12*b* to form a first layer 12*a* made of the PET sheet on the second layer 12*b*.

Thus, an exothermic phase transition layer 12 with a thickness of 60 μm composed of the first layer 12*a* and the second layer 12*b* was formed on the core metal 11.

The exothermic phase transition layer 12 was then covered with a heat-shrinkable tubing made of PFA as a protective layer 13 for the exothermic phase transition layer 12, sealed, heated to 250° C. under reduced pressure, and then rapidly cooled at a cooling rate of 50° C. or more per minute, whereby a comparative exothermic image fixing roller was fabricated, which is referred to as Comparative Sample No. 2-5 in TABLE 3.

Each of these image fixing rollers of Samples Nos. 2-1 to 2-5 of the present invention and Comparative Samples NOS. 2-1-1, 2-1-2, 2-2, 2-3, 2-4-1 and 2-4-2 was incorporated into the image fixing apparatus of a commercially available electrophotographic copying machine (Trademark M210 made by Ricoh Company, Ltd.) and the elevation of the surface temperature of each image fixing roller was investigated under the application of electric power of 960 W to the heater. The results are shown in TABLE 3.

TABLE 3

| Sample No. | Structure of Exothermic Phase Transition Layer | Elevation of Surface Temperature of Image Fixing Roller | Stability in Repeated Use |
|---|---|---|---|
| Sample No. 2-1 | D/A | Two temperature elevation peaks with quick elevation to image fixing temperature | No changes |
| Sample No. 2-2 | B/A | ditto | No changes |
| Sample No. 2-3 | D/C | ditto | No changes |
| Sample No. 2-4 | D/H/E | ditto | No changes |
| Sample No. 2-5 | C/I/A | ditto | No changes |
| Comp. Sample No. 2-1-1 | A | Single temperature elevation peak with slow elevation to image fixing temperature | No changes |
| Comp. Sample No. 2-1-2 | D | ditto | No changes |
| Comp. Sample No. 2-2 | B | ditto | No changes |
| Comp. Sample No. 2-3 | C | ditto | No changes |
| Comp. Sample No. 2-4-1 | E | ditto | No changes |
| Comp. Sample No. 2-4-2 | D/E | Two temperature elevation peaks with quick elevation to image fixing temperature only at initial stage | Peak temperature changed |

TABLE 3-continued

| Sample No. | Structure of Exothermic Phase Transition Layer | Elevation of Surface Temperature of Image Fixing Roller | Stability in Repeated Use |
|---|---|---|---|
| Comp. Sample No. 2-5 | C/A | ditto | Peak temperature changed |

A: Diphenyl isophthalate derivative
B: Diphenyl carbonate adduct bisphenol A derivative
C: Polyethylene terephthalate
D: SeTe alloy containing 8 wt. % of Te
E: SeTe alloy containing 50 wt. % of Te
H: stainless steel
I: Aluminum The above results of Samples Nos. 2-1 to 2-5 of the present invention in the embodiment mode 2 were almost the same as the results of Samples Nos. 1-1, 1-2 and 1-3 of the present invention in the embodiment mode 1. However, as in Comparative Sample No. 2-4-2 and Comparative Sample No. 2-5, when the compatible exothermic phase transition materials were overlaid, the respective crystallization initiation temperatures thereof were shifted in the course of repeated use thereof, so that the exothermic function thereof deteriorated. In contrast to this, when the barrier layer 12*d* was provided between the first layer 12*a* and the second layer 12*b* as in Examples 2-4 and 2-5, the crystallization initiation temperatures of the exothermic phase transition materials did-not change, and were stable in the course of repeated use thereof.

In the embodiment mode 1 of the present invention, the exothermic phase transition layer 12 comprises a mixture of the first phase transition material and the second phase transition material and is provided on the core metal 11, while in the embodiment mode 2 of the present invention, the exothermic phase transition layer 12 comprises at least two layers, that is, the first layer comprising the first exothermic phase transition material and the second layer comprising the second exothermic phase transition material, which are overlaid on the core metal 11.

When two or more exothermic phase transition materials are used in the image fixing roller 14, the crystallization ranges, compatibilities, melting points, glass transition temperatures and other characteristics of the respective exothermic phase transition materials will have to be checked and an appropriate combination of the exothermic phase transition materials have to be selected. Therefore, even in the above-mentioned two modes 1 and 2 of image fixing rollers of the present invention, there are some restriction to the combination of the exothermic phase transition materials.

For instance, when an exothermic phase transition material having a melting point of about 300° C. or more is used in a crystallized exothermic phase transition layer 12 and the crystallized exothermic phase transition layer 12 is fused, the melting point of the exothermic phase transition material is too high to be used in practice when the self-ignition temperature of an image transfer paper P is taken into consideration.

On the other hand, when the melting point of the exothermic phase transition material is less than the image fixing possible temperature, the exothermic phase transition material fuses in the course of the temperature elevation to the image fixing possible temperature, absorbing the heat of fusion thereof, so that the temperature elevation of the image fixing roller 10 cannot be accelerated, but is rather hindered.

When the glass transition temperature of the exothermic phase transition material is below room temperature, the exothermic phase transition layer 12 in an amorphous state is crystallized with time. Furthermore, when the exothermic phase transition layer 12 comprises two kinds of exothermic phase transition materials which are compatible, that is, soluble in each other, the two exothermic phase transition materials mutually dissolve.

It is generally considered that crystallization temperatures such as crystallization initiation temperature Tci, exothermic peak temperature Tcp, and crystallization finalization temperature Tcf, are intrinsic to each exothermic phase transition material. Furthermore, glass transition temperature Tg and melting point Tm are also considered to be intrinsic to each material. Therefore, it is considered that a material having particular crystallization temperatures may have its intrinsic melting point Tm.

The inventors of the present invention have discovered that one exothermic phase transition material may have one set of the above-mentioned particular intrinsic crystallization temperatures (Tci, Tcp and Tcf) in the state of a lump or in bulk, but the same exothermic phase transition material may have a second set of intrinsic crystallization temperatures (Tci, Tcp and Tcf), when subjected to a pulverizing treatment, which are lower than those of the exothermic phase transition material in bulk. In accordance with this discovery, it is possible to expand the range of the above-mentioned intrinsic crystallization temperatures (Tci, Tcp and Tcf) without changing its intrinsic melting point Tm and glass transition point Tg.

It is considered that this phenomenon is caused by conditions at the growth of crystals such as the direction of the growth of crystals and the anisotropy of the growth rate of crystals.

For instance, snow flakes are branched, six-point star crystals, that is, in the form of dendrite, or are short prismatic in shape as in quartz. It is known that these different crystals of snow flakes are formed under different conditions for the growth of the crystals.

It is known that Se-based amorphous materials, when crystallized, have different crystallization patterns depending upon the particle size thereof in the course of crystallization thereof. It is considered that the different crystallization patterns are formed in accordance with the following mechanism:

Selenium in the form of a bulk, for instance, with a particle size of 0.5 mm or more exhibits a single exothermic single peak when crystallized, while a pulverized selenium, for instance, with a particle size in the range of 0.2 to 0.5 mm, exhibits double peaks when crystallized.

The enthalpy of activation for the crystallization of the pulverized Se generated with the above-mentioned double peaks in crystallization in a low temperature region peak is 1.3 eV (379 cal/g), and that in a high temperature region peak is 1.0 eV (292 cal/g).

With respect to a pulverized SeTe alloy containing 6 wt. % of Te, a similar measurement data to that mentioned above is obtained that the enthalpy of activation for the crystallization of the SeTe alloy in a low temperature region is higher than that in a high temperature region. This indicates that the crystallization is easy to take place in a high temperature region, while the crystallization is relatively difficult to take place in the low temperature peak.

In view of the fact that the above-mentioned Se in bulk exhibits a single exothermic peak for crystallization, it is considered that in the Se in bulk the crystallization based the low temperature region peak as in the pulverized Se is difficult to take place.

When a chalcogen such as Se in bulk is ground or pulverized, the bonds in the bulk are ruptured between the rupture surfaces of the bulk so that countless dangling bonds are formed. These dangling bonds, when allowed to stand in air, are bonded to oxygen atoms to become stabilized. On the other hand, it is confirmed that Se tends to become crystallized in accordance with the increase in the ambient concentration of oxygen as reported in Japanese Laid-Open Patent Application 7-144130. From these facts, it can be said that the dangling bonds themselves work as nuclei for crystallization, and the stabilized dangling bonds bonded to oxygen atoms also work as nuclei for crystallization, so that the pulverizing or grinding of Se contributes to the formation of a large number of the nuclei for crystallization, which promotes the growth of crystals at the pulverized or ground surfaces thereof.

In chalcogen such as Se in the form of a bulk, the crystals thereof grow in the form of spherical crystals. However, the crystals thereof in a vacuum deposited thin film are in a radiately extending flat form, for instance, in the shape of a jellyfish or a mushroom, and are larger in size than the crystals in the bulk. It is considered that this indicates that the growth of the crystallization on a surface is faster than that in the bulk. In other words, in the pulverized chalcogen on the surface of the vacuum deposited film, the crystal growth rate is increased.

Thus, in the chalcogen, when pulverized, the crystallization thereof can be significantly promoted because of the formation of a number of nuclei for crystallization at the surface of the particles thereof and also because of the greater crystal growth in the particles than in the bulk.

As mentioned above, Se in the form of a bulk exhibits a single exothermic single peak when crystallized, while a pulverized Se exhibits double peaks when crystallized. It is considered that the generation of the double peaks in the pulverized Se indicates that the pulverized Se is in such a state that the crystallization can be significantly promoted for the above-mentioned reasons in comparison with the bulk Se.

The mechanism of crystallization of organic polymers appears more complex than that in the crystallization of the above-mentioned chalcogen. However, the relationship between the crystallization in the bulk and that on the free surface of pulverized particles is considered to the same as in the above-mentioned chalcogen. More specifically, the generation of a second exothermic peak for crystallization can be promoted by pulverizing the organic polymer and increasing the surface area thereof, or by depositing a conventionally known nuclei agent for crystallization on the surface of the particles of the pulverized organic polymer.

Embodiment Mode 3

An exothermic phase transition material for use in embodiment mode 3 of the present invention has a plurality of exothermic temperatures in the course of the crystallization thereof, and the crystallization thereof is carried out in a wider temperature range in comparison with an exothermic phase transition material having a single exothermic temperature in the course of the crystallization thereof.

Therefore, when the exothermic phase transition material for use in embodiment mode 3 is used, the exothermic temperature elevation is initiated at a relatively low temperature and continued to a high temperature near the image fixing temperature for the image fixing roller.

Furthermore, the exothermic phase transition material for use in embodiment mode 3 consists of a single component and therefore has a single endothermic temperature when melted. Therefore, the exothermic phase transition material can be made amorphous by heating the material to a single temperature which is the melting point thereof or above the melting point thereof. Therefore, the selection of such an exothermic phase transition material is easier than the case where an exothermic phase transition material comprising a plurality of different component materials.

Furthermore, the exothermic phase transition layer 12 can be fabricated, using the exothermic phase transition material for use in the embodiment mode 3, which is composed of the material with selectively different particle sizes.

More specifically, alloys composed of chalcogen elements, when pulverized, can be caused to generate a new crystallization initiation temperature in a low temperature region. Of the chalcogen alloys, selenium alloys' melting points do not go far beyond 217° C., since Se has a melting point of 217° C. Therefore, it is not necessary to heat the alloys to a high temperature when the alloys in an amorphous state are initialized by fusing the same. Therefore, such alloys can be used effectively as the exothermic phase transition materials for use in the embodiment mode 3.

As the exothermic phase transition material for the exothermic phase transition layer 12 in embodiment mode 3, selenium pellets made of selenium with a purity of 99.999%, which are prepared by the molten underwater shot method.

According to the studies by the inventors of the present invention, the high purity selenium is pulverized, a second crystallization initiation temperature is generated. In order to confirm this phenomenon, the pellets of the selenium were pulverized and the particles of the pulverized selenium were classified into particles with a particle size of more than 0.5 mm (Test Sample No. 1), particles with a particle size of 0.2 to 0.5 mm (Test Sample No. 2), and particles with a particle size of less than 0.1 mm (Test Sample No. 3).

Each of these test samples was heated with a temperature elevation rate of 10° C. per minute, and was subjected to a differential thermal analysis (DTA). The results are shown in TABLE 4.

TABLE 4

| Test Sample | Particle | Shape of | Glass Transition Temperature (° C.) | Low-temperature-side Crystallization Temperature (° C.) | | High-temperature-side Crystallization Temperature (° C.) | | | Melting Point (° C.) | Shape of Exothermic |
|---|---|---|---|---|---|---|---|---|---|---|
| No. | Size | Particles | Tg | Tci 2 | Tcp 2 | Tci 1 | Tcp 1 | Tcf | Tm | Peak |
| 1 | more than 0.5 mm | Bulk | 42 | — | — | 130 | 140 | 150 | 217 | Single Peak |
| 2 | 0.2–0.5 mm | Powder | 42 | 90 | 110 | — | 140 | 150 | 217 | Double Peaks |

TABLE 4-continued

| Test Sample No. | Particle Size | Shape of Particles | Glass Transition Temperature (° C.) Tg | Low-temperature-side Crystallization Temperature (° C.) Tci 2 | Tcp 2 | High-temperature-side Crystallization Temperature (° C.) Tci 1 | Tcp 1 | Tcf | Melting Point (° C.) Tm | Shape of Exothermic Peak |
|---|---|---|---|---|---|---|---|---|---|---|
| 3 | less than 0.1 mm | Fine Powder | 42 | 90 | 110 | — | 140 | 150 | 217 | Broad Peak |
| 4 | 0.1 mm | Vapor-deposited Film | 42 | — | — | 130 | 140 | 150 | 217 | Single Peak |

Figure 1:
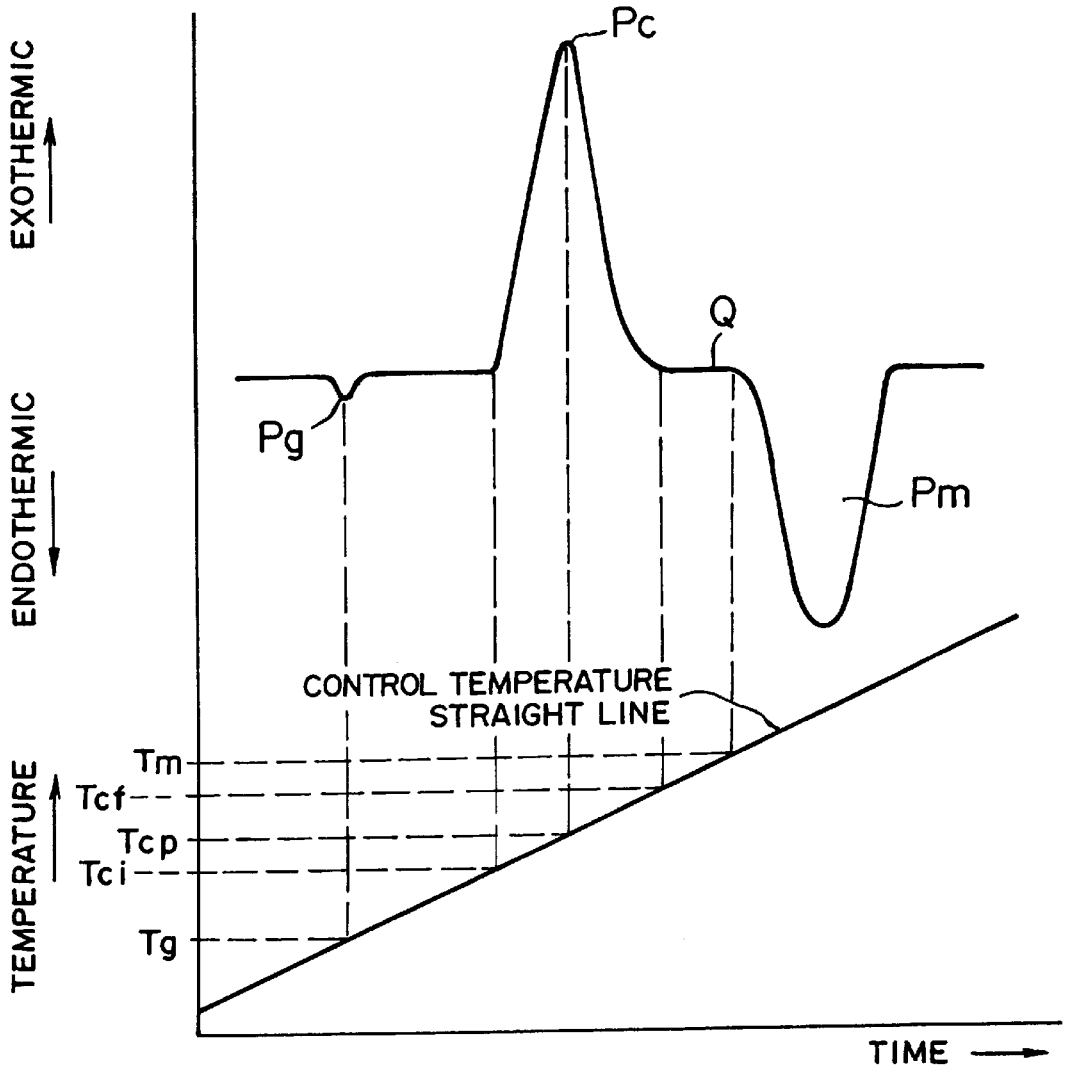
FIG. 1 is a graph of a differential thermal analysis (DTA) curve in explanation of the exothermic characteristics of an exothermic phase transition material for use in the present invention.
Figure 14:
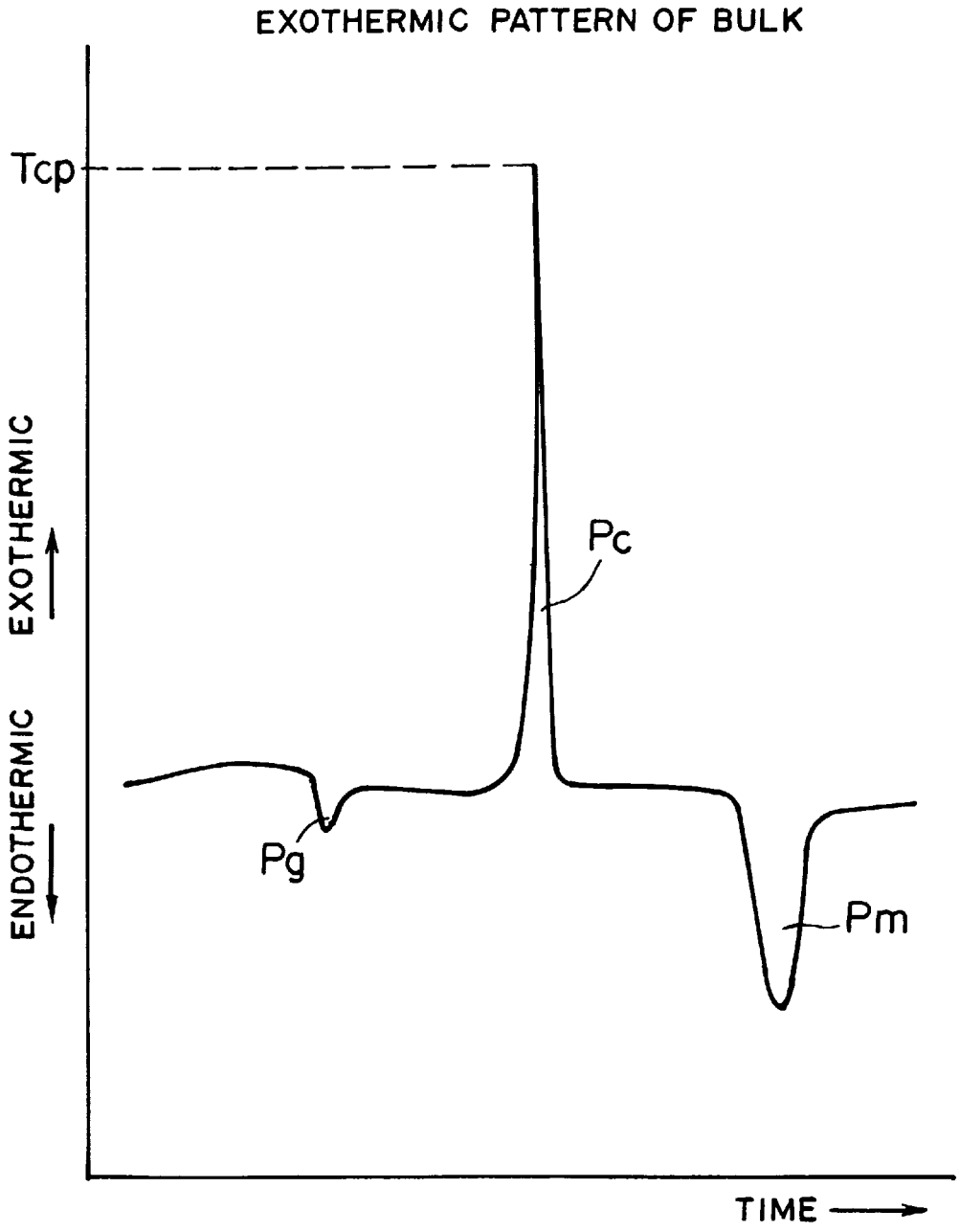
FIG. 14 is a graph of a differential thermal analysis (DTA) curve of a bulk of a high purity Se, showing the exothermic characteristics thereof in the course of the crystallization thereof.
Figure 15:
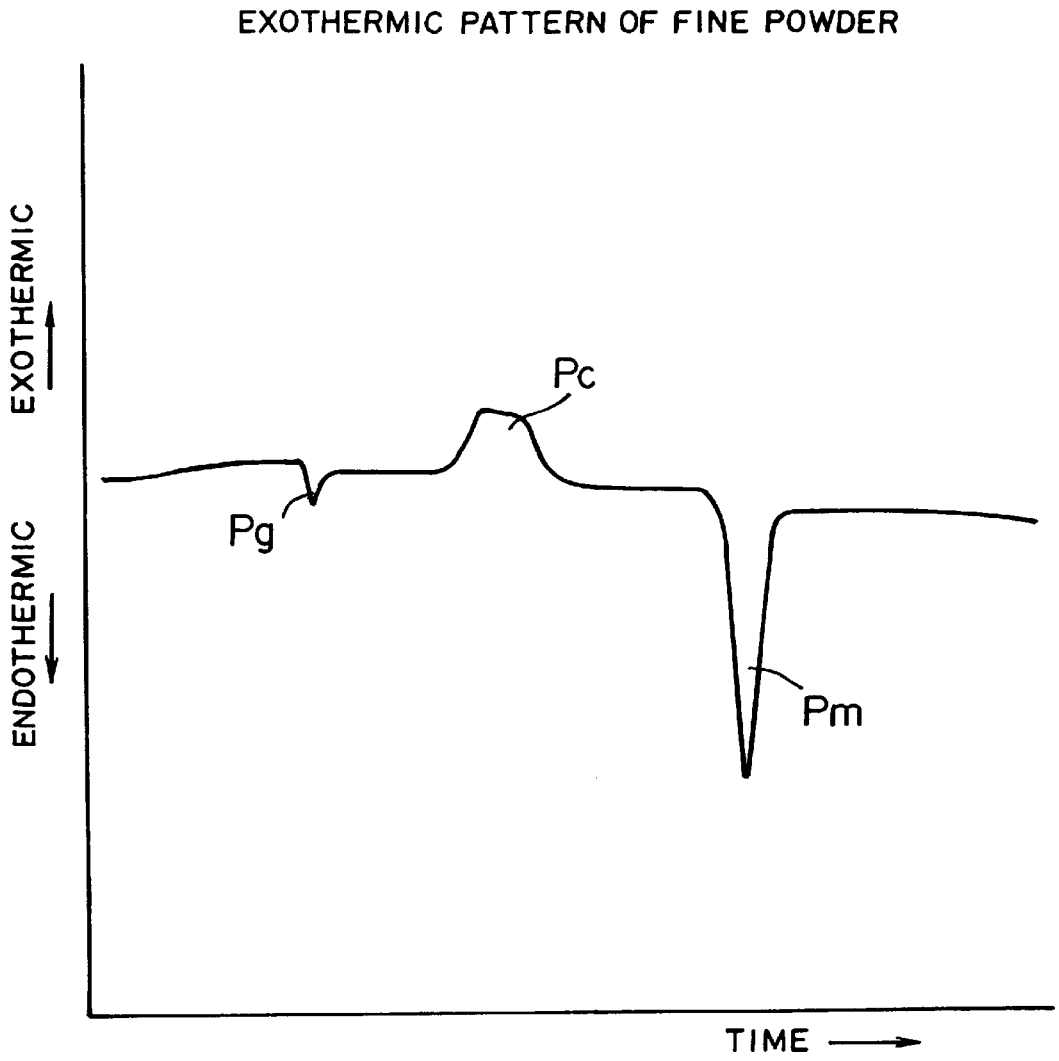
FIG. 15 is a graph of a differential thermal analysis (DTA) curve of a fine-powder of a high purity Se, showing the exothermic characteristics thereof in the course of the crystallization thereof.

The bulk of Test Sample No. 1, as shown in FIG. 14, exhibits the same exothermic pattern for the crystallization as in FIG. 1, with a sharp exothermic peak temperature Tcp.

In contrast to this, the fine powder of Test Sample No. 3, which was prepared by mechanically pulverizing the selenium pellets to a particle size of less than 0.1 mm, exhibits an exothermic peak which is extended to a low temperature side, with a relatively large quantity of exothermic heat.

Test Samples No. 2 and No. 3 exhibit a low-temperature-side exothermic peak temperature Tcp2 (110° C.) in addition to a high-temperature-side exothermic peak temperature Tcp1 (140° C.), so that the exothermic phase transition materials in these samples are considered to have a broad exothermic range from the low temperature side to the high temperature side. From this fact, it can be understood that the crystallization initiation temperature of such a material can be controlled or changed by changing the particle size of the material.

Thus, the exothermic phase transition materials of Test Samples No. 2 and No. 3 are considered to be useful as the materials for promoting the temperature elevation in the broad exothermic range from the low temperature side to the high temperature side.

In particular, the material of Test Sample No. 3 has a broader exothermic pattern that of the material of Test Sample No. 2, so that the material of Test Sample No. 3 has an effect of elevating the temperature smoothly and continuously over a wide temperature range. The melting points Tm and the glass transition temperatures Tg of the materials of Test Sample No. 2 and Test Sample No. 3 are respectively substantially the same as the melting point Tm and the glass transition temperature Tg of the material of Test Sample No. 1.

As a reference example for the above-mentioned Test Samples Nos. 1 to 3, the same selenium pellets as mentioned above were vapor deposited in vacuum on a substrate at a substrate temperature of 50° C. to form a vapor evaporated film of the selenium with a thickness of 0.1 mm. The thus prepared vapor deposited film of the selenium was peeled away from the substrate to prepare Test Sample No. 4.

The thus prepared Test Sample No. 4 was subjected to the same differential thermal analysis (DTA) as for Test Samples Nos. 1 to 3. The results are also shown in TABLE 4. In the case of the vapor deposited film, even when the film is as thin as 0.1 mm, a second exothermic peak was not observed.

Figure 16:
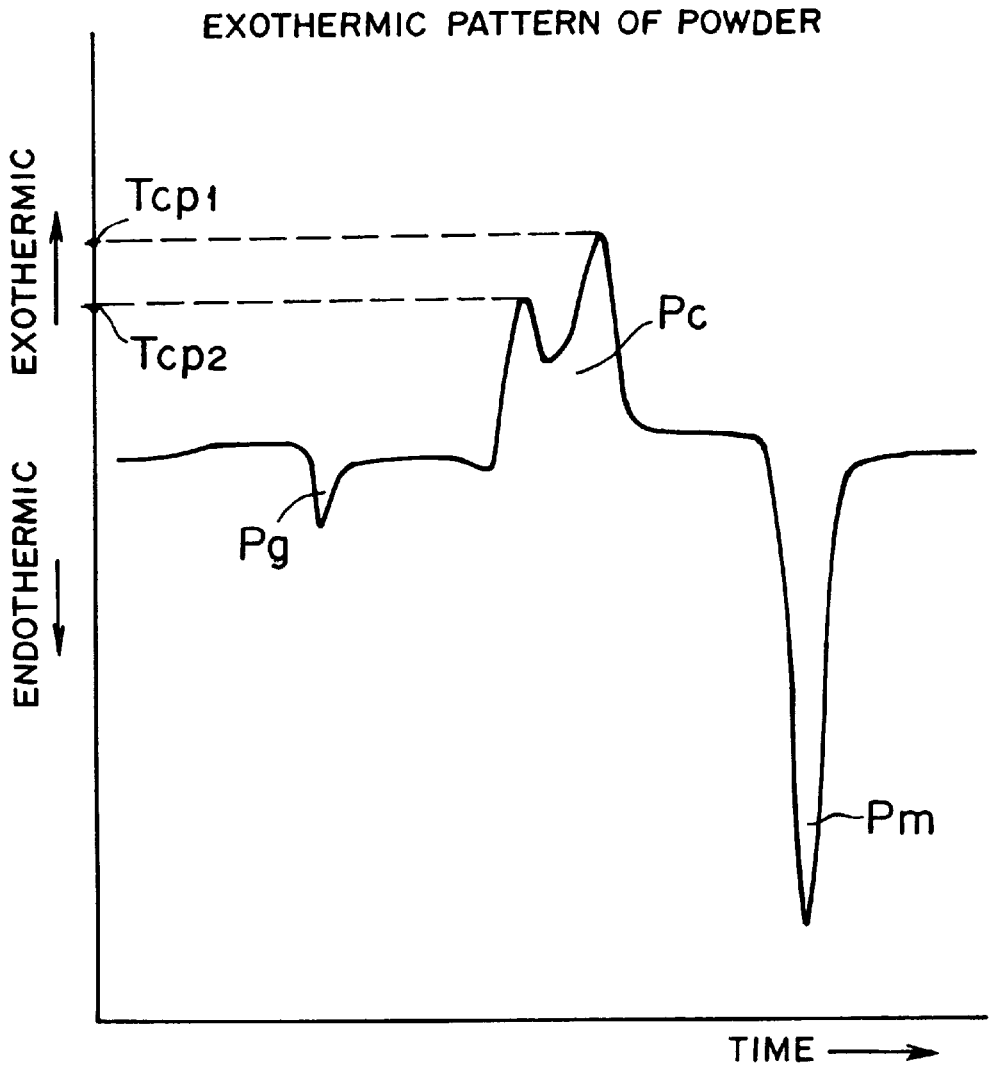
FIG. 16 is a graph of a differential thermal analysis (DTA) curve of a powder of a SeTe alloy, showing the exothermic characteristics thereof in the course of the crystallization thereof.

A SeTe alloy containing 6 wt. % of Te and a SeTe alloy containing 50 wt. % of Te (m.p. 285° C.) were also pulverized, classified and subjected to the same differential thermal analysis (DTA) as for the above-mentioned Test Samples Nos. 1 to 3. The results are shown in FIG. 16. As shown in FIG. 16, the exothermic peat temperature Pc is slightly shifted to the high temperature side in comparison with that of the high purity Se, the exothermic behavior of the two SeTe alloys was exactly the same as the exothermic behavior of the high purity Se, with the generation of the two exothermic peaks, whereby it can be confirmed that such chalcogenide compounds' exothermic behavior is the same as Se's exothermic behavior.

Furthermore, it is confirmed that the double peak pattern in the DTA pattern of each of the finely pulverized Se and the finely pulverized SeTe alloys can be maintained even if such pulverized Se and alloys are allowed to stand for several years. This indicates that these finely pulverized materials are sufficiently durable materials for use in heat-applied image transfer rollers or image fixing rollers.

As can be seen from the above, in the embodiment mode 3 of the present invention, the exothermic temperature range of the exothermic phase transition material can be controlled by controlling the particle size of the exothermic phase transition material. For example, an exothermic phase transition material which liberates a large quantity of heat exothermically in a low temperature range can be prepared by pulverizing the exothermic phase transition material so as to decrease the particle size thereof.

In other words, by using the same exothermic phase transition material, but with different particle sizes in appropriate combination, there can be formed an exothermic phase transition layer 12 that can elevate the temperature of the image fixing roller 10 over a wide temperature range from a low temperature range to a high temperature in the same manner as in the exothermic phase transition layers for the embodiment modes 1 and 2 of the present invention.

Figure 17:
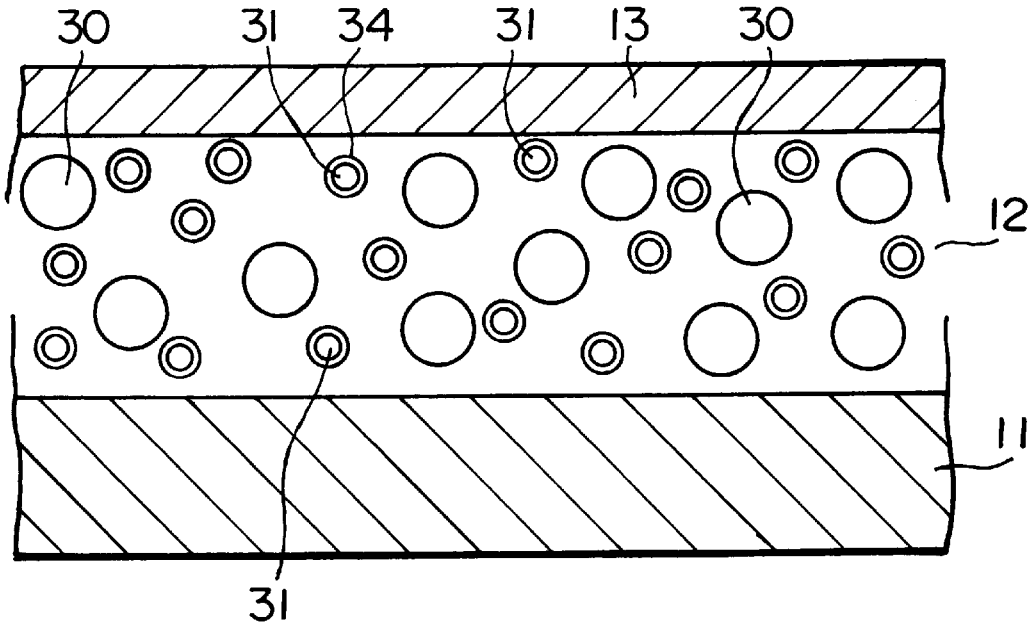
FIG. 17 is a schematic cross-sectional view of an exothermic phase transition layer provided on a core metal of an image fixing roller of the present invention, which exothermic phase transition layer consists of an exothermic phase transition material in the form of particles with different particle sizes, with the surface of the particles with a smaller particle size being coated with a thermal conductive shape supporting material.
Figure 18:
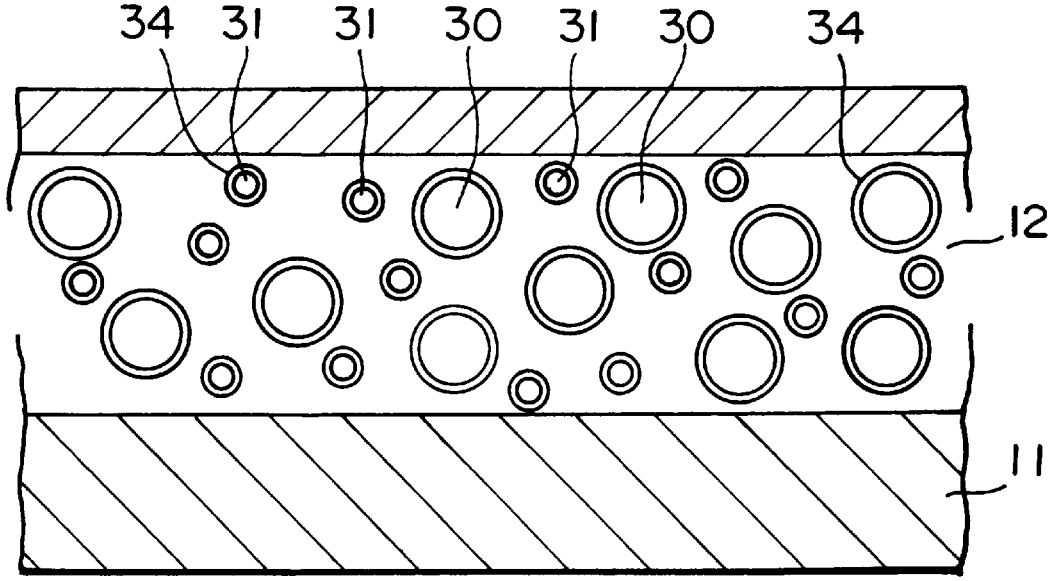
FIG. 18 is a schematic cross-sectional view of an exothermic phase transition layer provided on a core metal of an image fixing roller of the present invention, which exothermic phase transition layer comprising an exothermic phase transition material in the form of first particles and second particles with different particle sizes, with the surface of both the first and second particles being coated with a thermal conductive shape supporting material.
Figure 19:
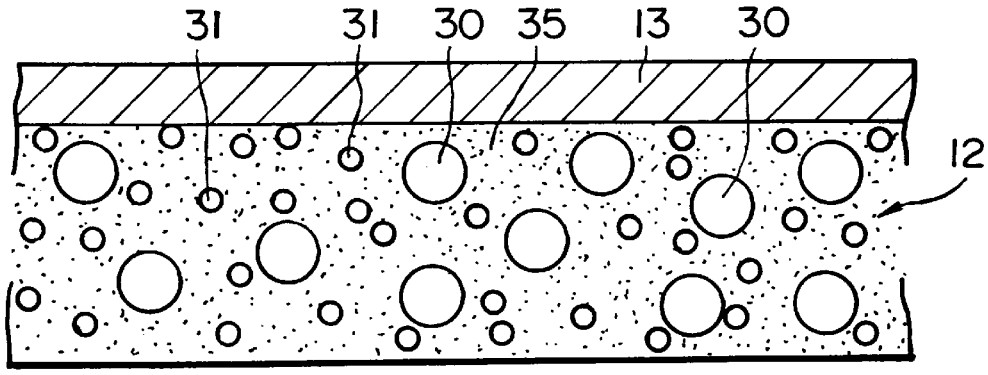
FIG. 19 is a schematic cross-sectional view of an exothermic phase transition layer provided on a core metal of an image fixing roller of the present invention, which exothermic phase transition layer comprising an exothermic phase transition material in the form of first particles and second particles with different particle sizes, which are uniformly dispersed in a thermal conductive material.

The exothermic phase transition layer 12 for the embodiment 3 may be a single layer comprising a mixture of first particles 30 and second particles 31 of an exothermic phase transition material as shown in FIG. 17 to FIG. 19.

When the exothermic phase transition layer 12 is composed of a single layer comprising a mixture of first particles 30 and second particles 31 of an exothermic phase transition material, it is preferable that the first particles 30 and the second particles 31 of the exothermic phase transition material be uniformly dispersed in the exothermic phase transition layer 12.

Since the first particles 30 and the second particles 31 in the exothermic phase transition layer 12 are made of an identical exothermic phase transition material, the melting points Tm and the freezing points Tm' thereof are the same. Therefore, in order to prevent the first particles 30 and the second particles 31 from being mutually dissolved when fused, it is necessary that the first particles 30 and the second particles 31 be separately supported by a thermal conductive shape supporting material having a melting point higher than the melting point of the first particles 30 and the second particles 31.

In particular, when the second particles 31 are smaller in particle size than the first particles 30, the crystallization initiation temperature of the second particles 31 is lower than that of the first particles 30, so that it is preferable that the surface of the second particles 31 be coated with a shape supporting material 34 which is a thermal conductive shape supporting material having a melting point higher than the melting point of the first particles 30 and the second particles 31, as shown in FIG. 17, in order to maintain the crystallization initiation temperature of the second particles 31.

Alternatively, as shown in FIG. 18, the surface of both the first particles 30 and the second particles 31 may be coated with the shape supporting material 34.

Furthermore, as shown in FIG. 19, the first particles 30 and the second particles 31 may be uniformly dispersed in a thermal conductive shape supporting material 35 having a melting point higher than the melting point of the first particles 30 and the second particles 31. In this case, it is unnecessary to coat the surface of the first particles 30 and the second particles 31 with the shape supporting material 34.

Figure 20:
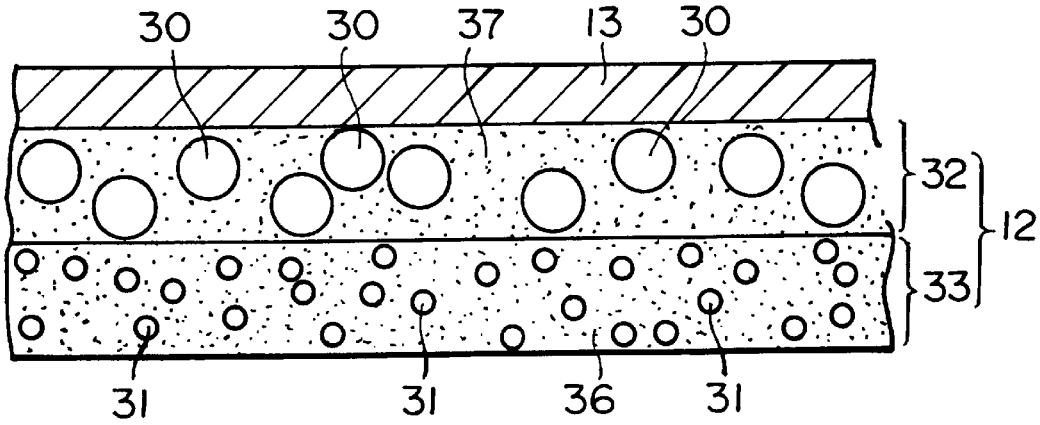
FIG. 20 is a schematic cross-sectional view of an exothermic phase transition layer provided on a core metal of an image fixing roller of the present invention, which exothermic phase transition layer comprising a first layer comprising a first exothermic phase transition material in the form of particles and a second layer comprising a second exothermic phase transition material in the form of particles with a different particle size from the particle size of the first exothermic phase transition material.

As shown in FIG. 20, the first particles 30 may be uniformly dispersed in a thermal conductive shape supporting material 37 to form a first layer 32, and the second particles 31 may be uniformly dispersed in a thermal conductive shape supporting material 36 to form a second layer 33, with the first layer 32 being overlaid on the second layer 33 so as to form the exothermic phase transition layer 32. It is preferable that the first layer 32 be overlaid on the second layer 33 so as to form the exothermic phase transition layer 32 as shown in FIG. 20. As the first layer 32, a vapor-deposited layer may also be used.

As the thermal conductive shape supporting material, for instance, an epoxy adhesive agent and a thermoplastic polyimide adhesive agent can be employed.

In order to make amorphous the exothermic phase transition material in the form of particles coated with the shape supporting material by fusing the exothermic phase transition material with the application of heat thereto, it is preferable that the shape supporting material be such a material that is neither fused nor decomposed and is capable of maintaining the original shape of the particles of the exothermic phase transition material in the course of the step of making the exothermic phase transition material amorphous. Examples of such materials for use in the shape support material are cross-linked polymeric polymers and polymers with high melting points.

In the above examples of the present invention, the exothermic phase transition material in a crystallized state is heated to convert the state thereof to a fused state and the exothermic phase transition material in the fused state is then rapidly cooled to convert the fused state to an amorphous state, in order to perform the phase transition from a crystallized solid state to an amorphous solid state of the exothermic phase transition material. This phase transition from a crystallized solid state to an amorphous solid state of the exothermic phase transition material can also be performed by ion injection into the crystallized solid exothermic phase transition material, using an ion-injection apparatus, which can be incorporated into a copying machine.

In the embodiment mode 3 of the present invention, the temperature elevation of the image fixing roller can be promoted in a wide temperature range, using one exothermic phase transition material, so that various restrictions encountered when an exothermic phase transition material composed of a plurality of exothermic phase transition component materials can be significantly removed. Furthermore, in the embodiment mode 3 of the present invention, by dispersing the exothermic phase transition material with different particle sizes uniformly in the exothermic phase transition layer of the image fixing roller, the temperature elevation promotion effect obtained by the exothermic phase transition material is uniform in the entire image fixing surface of the image fixing roller.

In the embodiment mode 3 of the present invention, the crystallization temperature range of the exothermic phase transition material can be expanded by mechanically pulverizing the exothermic phase transition material.

Furthermore, even when the exothermic phase transition material, which is in the shape of particles, is fused to make the material amorphous, the particles of the material are separately coated with the thermal conductive shape supporting material, so that the particles are not mutually fused and dissolved, but the shape of the particles can be maintained, during the course of the repeated use thereof. Since the shape supporting material is thermal conductive, the heat conduction efficiency of the exothermic phase transition layer composed of the above exothermic phase transition material in the embodiment mode 3 is excellent.

Japanese Patent Application No. 09-008607 filed Jan. 21, 1997, Japanese Patent Application No. 09-352874 filed Dec. 22, 1997, Japanese Patent Application No. 09-352875 filed Dec. 22, 1997, and Japanese Patent Application No. 09-352876 filed Dec. 22, 1997 are hereby incorporated by reference.

What is claimed is:

1. A heating apparatus for heating a material to a predetermined temperature, comprising:

1) a core;

2) a heating element; and 3) an exothermic phase transition layer formed on said core, which performs a plurality of phase transitions repeatedly from an amorphous state to a crystalline state, comprising a plurality of component exothermic phase transition layers, each component layer configured to perform reversible phase transition from an amorphous state to a crystalline state with liberation of crystalline heat therefrom, and vice versa, and having a different crystallization initiation temperature (Tci), a different exothermic peak temperature (Tcp), and a melting point higher than said predetermined temperature.

2. The heating apparatus as claimed din claim 1, wherein said exothermic phase transition materials are insoluble to each other when fused.

3. A heating apparatus for heating a material to a predetermined temperature, comprising:

1) a core;

2) a heating element; and 3) an exothermic phase transition layer formed on said core, which performs a plurality of phase transitions repeatedly from an amorphous state to a crystalline state, comprising a plurality of exothermic phase transition materials, each of which is capable of performing reversible phase transition from an amorphous state to a crystalline state with liberation of crystalline heat therefrom, and vice versa, and has a different crystallization initiation temperature (Tci), a different exothermic peak temperature (Tcp), and a melting point higher than said predetermined temperature;

wherein said exothermic phase transition layer comprises a plurality of component layers which are overlaid with each other, each component layer comprising at least one of said exothermic phase transition materials and having a different crystallization initiation temperature (Tci) and a different exothermic peak temperature (Tcp).

4. The heating apparatus as claimed in claim 1, wherein said component layers are overlaid in such an order that the crystallization initiation temperature (Tci) of each component layer increases in the direction toward the outer surface of said heating element.

5. The heating apparatus as claimed in claim 3, wherein said exothermic phase transition layer further comprises respective barrier layers between each of said component layers, said barrier layers having a melting point which is higher than melting points of said component layers adjacent to said respective barrier layers.

6. A heating apparatus for heating a material to a predetermined temperature, comprising:

1) a core;

2) a heating element; and 3) an exothermic phase transition layer formed on said core, which performs a plurality of phase transitions repeatedly from an amorphous state to a crystalline state, comprising a plurality of exothermic phase transition materials, each of which is capable of performing reversible phase transition from an amorphous state to a crystalline state with liberation of crystalline heat therefrom, and vice versa, and has a different crystallization initiation temperature (Tci), a different exothermic peak temperature (Tcp), and a melting point higher than said predetermined temperature;

wherein when said exothermic phase transition materials are placed in an increasing order of the crystallization initiation temperatures (Tci) thereof from low to high, the respective crystallization initiation temperatures TciA and TciB and the respective exothermic peak temperatures TcpA and TcpB of two adjacent exothermic phase materials A and B in terms of the crystallization initiation temperature thereof are in such a relationship that TciB is higher than TciA, but lower than TcpA, and TcpB is higher than TcpA.

7. A heating apparatus for heating a material to a predetermined temperature, comprising:

a) a heating device comprising:

1) a core;

2) a heating element; and 3) an exothermic phase transition layer formed on said core, wherein said exothermic phase transition layer performs a plurality of phase transitions repeatedly from an amorphous state to a crystalline state, comprising a plurality of component exothermic phase transition layers, each component layer having a different crystallization initiation temperature (Tci), a different exothermic peak temperature (Tcp), and a melting point higher than said predetermined temperature, and said heating element heats said exothermic phase transition layer to perform said plurality of phase transitions successively, fusing at least one of said component exothermic phase transition layers to generate a fused exothermic phase transition material; and b) a cooling member which cools said exothermic phase transition layer to perform said plurality of phase transitions repeatedly, cooling said fused component exothermic phase transition layers.

8. A heating apparatus for heating a material to a predetermined temperature, comprising:

a) a heating device comprising:

1) a core;

2) a heating element; and 3) an exothermic phase transition layer formed on said core, wherein said exothermic phase transition layer performs a plurality of phase transitions repeatedly from an amorphous state to a crystalline state, comprising a plurality of exothermic phase transition materials, each of which has a different crystallization initiation temperature (Tci), a different exothermic peak temperature (Tcp), and a melting point higher than said predetermined temperature, and said heating element heats said exothermic phase transition layer to perform said plurality of phase transitions successively, fusing at least one of said exothermic phase transition materials to generate a fused exothermic phase transition material; and b) a cooling member which cools said exothermic phase transition layer to perform said plurality of phase transitions repeatedly, cooling said fused exothermic phase transition material;

wherein said cooling member cools said phase transition layer with such a cooling rate that an exothermic phase transition material having a highest melting point of all of said exothermic phase transition materials can be subjected to phase transition from a fused state to an amorphous state.

9. A heating apparatus for heating a material to a predetermined temperature, comprising:

a) a heating device comprising:

1) a core;

2) a heating element; and 3) an exothermic phase transition layer formed on said core, wherein said exothermic phase transition layer performs a plurality of phase transitions repeatedly from an amorphous state to a crystalline state, comprising a plurality of exothermic phase transition materials, each of which has a different crystallization initiation temperature (Tci), a different exothermic peak temperature (Tcp1), and a melting point higher than said predetermined temperature, and said heating element heats said exothermic phase transition layer to perform said plurality of phase transitions successively, fusing at least one of said exothermic phase transition materials to generate a fused exothermic phase transition material; and b) a cooling member which cools said exothermic phase transition layer to perform said plurality of phase transitions repeatedly, cooling said fused exothermic phase transition material;

wherein said cooling member cools said phase transition layer with such a cooling rate that an exothermic phase transition material which requires the highest cooling rate of all, of said exothermic phase transition materials can be subjected to phase transition from a fused state to an amorphous state.

10. A heating apparatus for heating a material to a predetermined temperature, comprising:

a) a heating device comprising:

1) a hollow core;

2) a heating element which is built in said hollow core;

3) an exothermic phase transition layer provided on the outer surface of said hollow core, wherein the exothermic phase transition layer performs a plurality of phase transitions repeatedly from an amorphous state to a crystalline state, and comprises a first component exothermic phase transition layer having a crystallization initiation temperature (Tci1), an exothermic peak temperature (Tcp1), and a melting point (Tm1) higher than said predetermined temperature, and a second component exothermic phase transition layer having a crystallization initiation temperature (Tci2) which is lower than said crystallization initiation temperature (Tci1) of said first exothermic phase transition layer, an exothermic peak temperature (Tcp2), and a melting point (Tm2) higher than said predetermined temperature, said first component exothermic phase transition layer and said second component exothermic phase transition layer being subjected to phase change from an amorphous state to a crystalline state to a fused state by said heating element, to utilize the heat liberated from said exothermic phase transition layer in the course of the phase change from said amorphous state to said crystalline state;

4) a protective layer provided on the outer surface of said exothermic phase transition layer; and (b) a cooling member which cools at least one of said first component exothermic phase transition layer and said second component exothermic phase transition, layer in said fused state to a crystalline solid state from outside said exothermic phase transition layer or from inside said hollow core.

11. The heating apparatus as claimed in claim 10, wherein the first exothermic peak temperature (Tcp1) of said first exothermic phase transition material is lower than the melting point (Tm2) of said second exothermic phase transition material.

12. The heating apparatus as claimed in claim 10, wherein said exothermic phase transition layer further comprises a thermal conductive material having a melting point which is higher than any of the melting points of said first exothermic phase transition material and said second exothermic phase transition material, said first exothermic phase transition material and said second exothermic phase transition material are in the form of particles and are discontinuously dispersed in said thermal conductive material.

13. A heating apparatus for heating a material to a predetermined temperature, comprising:

a) a heating device comprising:

1) a hollow core;

2) a heating element which is built in said hollow core;

3) an exothermic phase transition layer provided on the outer surface of said hollow core, wherein the exothermic phase transition layer performs a plurality of phase transitions repeatedly from an amorphous state to a crystalline state, and comprises a first exothermic phase transition material having a crystallization initiation temperature (Tci1), an exothermic peak temperature (Tcp1), and a melting point (Tm1) higher than said predetermined temperature, and a second exothermic phase transition material having a crystallization initiation temperature (Tci2) which is lower than said crystallization initiation temperature (Tci1) of said first exothermic phase transition layer, an exothermic peak temperature (Tcp2), and a melting point (Tm2) higher than said predetermined temperature, said first exothermic phase transition material and said second exothermic phase transition material being subjected to phase change from an amorphous state to a crystalline state to a fused state by said heating element, to utilize the heat liberated from said exothermic phase transition layer in the course of the phase change from said amorphous state to said crystalline state;

4) a protective layer provided on the outer surface of said exothermic phase transition layer; and (b) a cooling member which cools at least one of said first exothermic phase transition material and said second exothermic phase transition material in said fused state to a crystalline solid state from outside said exothermic phase transition layer or from inside said hollow core;

wherein said exothermic phase transition layer further comprises a thermal conductive material having a melting point which is higher than any of the melting points of said first exothermic phase transition material and said second exothermic phase transition material, said first exothermic phase transition material and said second exothermic phase transition material are in the form of particles, and said first exothermic phase transition material has an average particle size larger than that of said second exothermic phase transition material, and the surface of the particles of at least one of said first exothermic phase transition material or said second exothermic phase transition material is coated with said thermal conductive material.

14. A heating apparatus for heating a material to a predetermined temperature, comprising:

a) a heating device comprising:

1) a hollow core;

2) a heating element which is built in said hollow core;

3) an exothermic phase transition layer provided on the outer surface of said hollow core, wherein the exothermic phase transition layer performs a plurality of phase transitions repeatedly from an amorphous state to a crystalline state, and comprises a first exothermic phase transition material having a crystallization initiation temperature (Tci1), an exothermic peak temperature (Tcp1), and a melting point (Tm1) higher than said predetermined temperature, and a second exothermic phase transition material having a crystallization initiation temperature (Tci2) which is lower than said crystallization initiation temperature (Tci1) of said first exothermic phase transition layer, an exothermic peak temperature (Tcp2), and a melting point (Tm2) higher than said predetermined temperature, said first exothermic phase transition material and said second exothermic phase transition material being subjected to phase change from an amorphous state to a crystalline state to a fused state by said heating element, to utilize the heat liberated from said exothermic phase transition layer in the course of the phase change from said amorphous state to said crystalline state;

4) a protective layer provided on the outer surface of said exothermic phase transition layer; and (b) a cooling member which cools at least one of said first exothermic phase transition material and said second exothermic phase transition material in said fused state to a crystalline solid state from outside said exothermic phase transition layer or from inside said hollow core;

wherein said exothermic phase transition layer further comprises a thermal conductive material having a melting point which is higher than any of the melting points of said first exothermic phase transition material and said second exothermic phase transition material, said first exothermic phase transition material and said second exothermic phase transition material are in the form of particles, and said first exothermic phase transition material has an average particle size larger than that of said second exothermic phase transition material, and said first exothermic phase transition material and said second exothermic phase transition material dispersed in said thermal conductive material.

15. A heating apparatus for heating a material to a predetermined temperature, comprising:

a) a heating device comprising:

1) a hollow core;

2) a heating element which is built in said hollow core;

3) an exothermic phase transition layer provided on the outer surface of said hollow core, wherein the exothermic phase transition layer performs a plurality of phase transitions repeatedly from an amorphous state to a crystalline state, and comprises a first exothermic phase transition layer comprising a first exothermic phase transition material having a crystallization initiation temperature (Tci1), an exothermic peak temperature (Tcp1), and a melting point (Tm1) higher than said predetermined temperature, and a second exothermic phase transition layer comprising a second exothermic phase transition material having a crystallization initiation temperature (Tci2) which is lower than said crystallization initiation temperature (Tci) of said first exothermic phase transition layer, an exothermic peak temperature (Tcp2) and a melting point (Tm2) higher than said predetermined temperature, said first exothermic phase transition material and said second exothermic phase transition material being subjected to phase change from an amorphous state to a crystalline state to a fused state by said heating element, to utilize the heat liberated from said exothermic phase transition layer in the course of the phase change from said amorphous state to said crystalline state;

4) a protective layer provided on the outer surface of said exothermic phase transition layer; and (b) a cooling member which cools at least one of said first exothermic phase transition material said second exothermic phase transition material in said fused state to a crystalline solid state from outside said exothermic phase transition layer or from inside said hollow core.

16. The heating apparatus as claimed in claim 15, wherein the first exothermic peak temperature (Tcp1) of said first exothermic phase transition material is lower than the melting point (Tm2) of said second exothermic phase transition material.

17. The heating apparatus as claimed in claim 15, wherein said exothermic phase transition layer further comprises a barrier layer having a melting point which is higher than any of the melting points of said first exothermic phase transition layer and said second exothermic phase transition layer between said first exothermic phase transition layer and said second exothermic phase transition layer, said barrier layer comprising a thermal conductive material having a melting point which is higher than any of the melting points of said first exothermic phase transition layer and said second exothermic phase transition layer.

18. The heating apparatus as claimed in claim 15, wherein said first exothermic phase transition layer is overlaid on said second exothermic phase transition layer in such a manner that said first exothermic phase transition layer is provided so as to be located at an outer position away from said core.

19. The heating apparatus as claimed in claim 15, wherein said first exothermic phase transition layer further comprises a thermal conductive material having a melting point which is higher than any of the melting points of said first exothermic phase transition material and said second exothermic phase transition material in which thermal conductive material, said first exothermic phase transition material is dispersed, and said second exothermic phase transition layer further comprises a thermal conductive material having a melting point which is higher than any of the melting points of said first exothermic phase transition material and said second exothermic phase transition material, in which thermal conductive material, said second exothermic phase transition material is dispersed.

20. A heating apparatus for heating a material to a predetermined temperature, comprising:

heat transfer means for applying heat to said material;

heating means for heating said heat transfer means and maintaining said heat transfer means at said predetermined temperature; and exothermic phase transition means for accelerating the heating of said heat transfer means to said predetermined temperature, using an at least first and second component exothermic phase transition layers which are capable of performing reversible phase transition from an amorphous solid state to a crystalline state with liberation of crystallization heat therefrom, and vice versa, and having said component exothermic phase transition layers successively liberate the crystallization heat at a plurality of different temperatures.

21. A heating apparatus for heating a material to a predetermined temperature, comprising:

heat transfer means for applying heat to said material, comprising an exothermic phase transition layer which performs a plurality of phase transitions repeatedly from an amorphous state to a crystalline state, and comprising a plurality of component exothermic phase transition layers, each component layer having a different crystallization initiation temperature (Tci), a different exothermic peak temperature (Tcp), and a melting point temperature which is higher than said predetermined temperature;

heating means for heating said exothermic phase transition layer to perform said plurality of phase transition successively, fusing at least one of said component exothermic phase transition layers; and cooling means for cooling said exothermic phase transition layer to perform said plurality of phase transition repeatedly, cooling said fused component exothermic phase transition layer.

22. A method of heating a material to a predetermined temperature, using an exothermic phase transition layer having a melting point temperature which is higher than said predetermined temperature, said exothermic phase transition layer performing a plurality of phase transitions repeatedly from an amorphous state to a crystalline state, and which comprises a first component exothermic phase transition layer having a crystallization initiation temperature (Tci1) and a second component exothermic phase transition layer having a crystallization initiation temperature (Tci2) which is lower than said crystallization initiation temperature (Tci1) of said first component exothermic phase transition layer, said method comprising the steps of:

subjecting said second component exothermic phase transition layer to a first phase change from the amorphous state to the crystalline state by heating said second component exothermic phase transition layer, thereby liberating heat from said second component exothermic phase transition layer; and subjecting at least said first component exothermic phase transition layer to a second phase change from the amorphous state to the crystalline state by heating said second component exothermic phase transition layer, thereby liberating heat from said first component exothermic phase transition layer, to successively use the liberated heat from said second component exothermic phase transition layer and the liberated heat from said first component exothermic phase transition layer successively in the respective phase change from said amorphous state to said crystalline state.

23. The method as claimed in claim 22, further comprising a step of returning the crystalline state of each of said first and second component phase transition layers to an amorphous state.

24. The method as claimed in claim 23, wherein said step of returning the crystalline state of each of said first and second component phase transition layers to an amorphous state comprises:

a process of fusing each of said first and second component phase transition layers in said crystalline state to a fused state, and a process of cooling each of said first and second component phase transition layers in said fused state to an amorphous state.

* * * * *

UNITED STATES PATENT AND TRADEMARK OFFICE

CERTIFICATE OF CORRECTION

PATENT NO. : 6,091,052
DATED : July 18, 2000
INVENTOR(S) : Minoru Matsuo et al.

It is certified that error appears in the above-identified patent and that said Letters Patent is hereby corrected as shown below:

Column 9,
Line 64, change “13” to -- 12 --.
Line 64, change “12” to -- 13 --.

Column 14,
Line 58, change “b” to -- by --.

Column 16,
Line 17, change “allow” to -- alloy --.

Column 24,
Line 45, delete “a”.

Column 27,
Line 31, change “did-not” to -- did not --.

Column 29,
Line 43, change “to the” to -- to be the --.

Column 34,
Line 48, change “din” to -- in --.
Line 49, change “said exothermic” to -- said component exothermic --.
Line 49, change “materials” to -- layers --.

Column 36,
Line 41, change “(Tcp1)” to -- (Tcp) --.

Signed and Sealed this

Third Day of May, 2005

JON W. DUDAS
*Director of the United States Patent and Trademark Office*